US009564007B2

(12) United States Patent
Dicillo et al.

(10) Patent No.: US 9,564,007 B2
(45) Date of Patent: Feb. 7, 2017

(54) WAGERING GAME CONTENT BASED ON LOCATIONS OF PLAYER CHECK-IN

(71) Applicant: WMS Gaming, Inc., Waukegan, IL (US)

(72) Inventors: Michael V. Dicillo, Norridge, IL (US); Dave Savage, Chicago, IL (US); Jamie W. Vann, Chicago, IL (US); Matthew J. Ward, Northbrook, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 157 days.

(21) Appl. No.: 13/786,128

(22) Filed: Mar. 5, 2013

(65) Prior Publication Data

US 2013/0324220 A1 Dec. 5, 2013

Related U.S. Application Data

(60) Provisional application No. 61/655,328, filed on Jun. 4, 2013.

(51) Int. Cl.
*G07F 17/32* (2006.01)

(52) U.S. Cl.
CPC ..... *G07F 17/3244* (2013.01); *G07F 17/3218* (2013.01); *G07F 17/3237* (2013.01); *G07F 17/3255* (2013.01)

(58) Field of Classification Search
CPC . G07F 17/323; G07F 17/3239; G07F 17/3255
See application file for complete search history.

(56) References Cited

U.S. PATENT DOCUMENTS

| | | | |
|---|---|---|---|
| 4,339,798 | A | 7/1982 | Hedges et al. |
| 4,455,025 | A | 6/1984 | Itkis |
| 4,527,798 | A | 7/1985 | Siekierski et al. |
| 4,624,459 | A | 11/1986 | Kaufman |
| 4,624,462 | A | 11/1986 | Itkis |
| 4,805,907 | A | 2/1989 | Hagiwara |
| 4,837,728 | A | 6/1989 | Barrie et al. |
| 4,842,278 | A | 6/1989 | Markowicz |
| 4,856,787 | A | 8/1989 | Itkis |
| 4,948,134 | A | 8/1990 | Suttle et al. |
| 5,102,138 | A | 4/1992 | Johnson |
| 5,116,055 | A | 5/1992 | Tracy |
| 5,249,800 | A | 10/1993 | Hilgendorf et al. |
| 5,275,400 | A | 1/1994 | Weingardt et al. |
| 5,280,909 | A | 1/1994 | Tracy |
| 5,299,803 | A | 4/1994 | Halaby |
| 5,344,144 | A | 9/1994 | Canon |

(Continued)

OTHER PUBLICATIONS

U.S. Appl. No. 13/776,871, filed Feb. 26, 2013, Guinn, Andrew C.

(Continued)

*Primary Examiner* — James S McClellan
*Assistant Examiner* — Kevin Carter
(74) *Attorney, Agent, or Firm* — DeLizio Law, PLLC

(57) ABSTRACT

A computer-implemented method comprises replacing, by one or more processors, original wagering game content with modified wagering game content based on a wagering game player's check-ins at one or more physical locations. The method also includes presenting, on an electronic display device, a wagering game with the modified wagering game content in place of the original wagering game content.

24 Claims, 13 Drawing Sheets

(56) References Cited

U.S. PATENT DOCUMENTS 5,359,528 A 10/1994 Haendel et al.
5,365,451 A 11/1994 Wang et al.
5,377,973 A 1/1995 Jones et al.
5,393,057 A 2/1995 Marnell, II
5,397,133 A 3/1995 Penzias
5,470,079 A 11/1995 LeStrange et al.
5,489,103 A 2/1996 Okamoto
5,524,888 A 6/1996 Heidel
5,544,892 A 8/1996 Breeding
5,564,700 A 10/1996 Celona
5,580,063 A 12/1996 Edwards
5,580,309 A 12/1996 Piechowiak
5,586,937 A 12/1996 Menashe
5,611,730 A 3/1997 Weiss
5,612,875 A 3/1997 Haendel et al.
5,618,232 A 4/1997 Martin
5,643,086 A 7/1997 Alcorn et al.
5,645,486 A 7/1997 Nago et al.
5,655,961 A 8/1997 Acres et al.
5,674,128 A 10/1997 Holch et al.
5,707,286 A 1/1998 Carlson
5,759,102 A 6/1998 Pease et al.
5,762,552 A 6/1998 Vuong et al.
5,766,076 A 6/1998 Pease et al.
5,770,533 A 6/1998 Franchi
5,774,872 A 6/1998 Golden et al.
RE35,864 E 7/1998 Weingardt
5,779,283 A 7/1998 Kimura et al.
5,779,549 A 7/1998 Walker et al.
5,797,794 A 8/1998 Angell
5,800,268 A 9/1998 Molnick
5,816,918 A 10/1998 Kelly et al.
5,823,874 A 10/1998 Adams
5,823,879 A 10/1998 Goldberg et al.
5,830,063 A 11/1998 Byrne
5,830,069 A 11/1998 Soltesz et al.
5,833,536 A 11/1998 Davids et al.
5,842,698 A 12/1998 Brown
5,848,932 A 12/1998 Adams
5,851,011 A 12/1998 Lott
5,851,149 A 12/1998 Xidos et al.
5,855,515 A 1/1999 Pease et al.
5,875,433 A 2/1999 Francisco et al.
5,876,284 A 3/1999 Acres et al.
5,885,158 A 3/1999 Torango et al.
5,909,486 A 6/1999 Walker et al.
5,921,865 A 7/1999 Scagnelli et al.
5,928,291 A 7/1999 Jenkins et al.
5,941,773 A 8/1999 Harlick
5,971,271 A 10/1999 Wynn et al.
5,971,849 A 10/1999 Falciglia
5,997,400 A 12/1999 Seelig et al.
6,001,016 A 12/1999 Walker et al.
6,004,205 A 12/1999 Lauretta et al.
6,007,427 A 12/1999 Wiener et al.
6,012,982 A 1/2000 Piechowiak et al.
6,012,983 A 1/2000 Walker et al.
6,012,984 A 1/2000 Roseman
6,016,479 A 1/2000 Taricani, Jr.
6,026,433 A 2/2000 D'Arlach et al.
6,039,648 A 3/2000 Guinn et al.
6,047,963 A 4/2000 Pierce et al.
6,077,162 A 6/2000 Weiss
6,078,899 A 6/2000 Fancisco et al.
6,089,977 A 7/2000 Bennett
6,089,980 A 7/2000 Gauselmann
6,102,474 A 8/2000 Daley
6,102,798 A 8/2000 Bennett
6,102,799 A 8/2000 Stupak
6,104,815 A 8/2000 Alcorn et al.
6,110,043 A 8/2000 Olsen
6,117,011 A 9/2000 Lvov
6,117,013 A 9/2000 Eiba
6,135,884 A 10/2000 Hedrick et al.
6,135,887 A 10/2000 Pease et al.
6,139,013 A 10/2000 Pierce et al.
6,142,872 A 11/2000 Walker et al.
6,146,273 A 11/2000 Olsen
6,149,522 A 11/2000 Alcorn et al.
6,154,172 A 11/2000 Piccionelli et al.
6,155,925 A 12/2000 Giobbi et al.
6,158,741 A 12/2000 Koelling
6,159,097 A 12/2000 Gura
6,164,651 A 12/2000 Webb
6,168,523 B1 1/2001 Piechowiak et al.
6,183,362 B1 2/2001 Boushy
6,183,366 B1 2/2001 Goldberg et al.
6,203,010 B1 3/2001 Jorasch et al.
6,204,560 B1 3/2001 Daetwyler et al.
6,206,374 B1 3/2001 Jones
6,206,782 B1 3/2001 Walker et al.
6,210,274 B1 4/2001 Carlson
6,210,275 B1 4/2001 Olsen
6,210,277 B1 4/2001 Stefan
6,217,448 B1 4/2001 Olsen
6,220,593 B1 4/2001 Pierce
6,224,482 B1 5/2001 Bennett
6,224,484 B1 5/2001 Okuda et al.
6,231,445 B1 5/2001 Acres
6,253,129 B1 6/2001 Jenkins
6,254,483 B1 7/2001 Acres
6,264,557 B1 7/2001 Schneier et al.
6,264,561 B1 7/2001 Saffari et al.
6,270,410 B1 8/2001 DeMar et al.
6,272,223 B1 8/2001 Carlson
6,273,821 B1 8/2001 Moriguchi
6,286,003 B1 9/2001 Muta
6,308,953 B1 10/2001 Nagano
6,309,299 B1 10/2001 Weiss
6,312,332 B1 11/2001 Walker et al.
6,315,660 B1 11/2001 DeMar et al.
6,319,125 B1 11/2001 Acres
6,319,127 B1 11/2001 Walker et al.
6,334,104 B1 12/2001 Hirai
6,336,859 B2 1/2002 Jones et al.
6,336,862 B1 1/2002 Byrne
6,345,824 B1 2/2002 Selitzky
6,346,048 B1 2/2002 Ogawa et al.
6,358,149 B1 3/2002 Schneider et al.
6,361,441 B1 3/2002 Walker et al.
6,364,768 B1 4/2002 Acres et al.
6,375,567 B1 4/2002 Acres
6,375,568 B1 4/2002 Roffman et al.
6,402,618 B1 6/2002 Reed et al.
6,406,371 B1 6/2002 Baba et al.
6,409,602 B1 6/2002 Wiltshire et al.
6,416,408 B2 7/2002 Tracy et al.
6,416,409 B1 7/2002 Jordan
6,422,940 B1 7/2002 Walker et al.
6,431,983 B2 8/2002 Acres
6,434,398 B1 8/2002 Inselberg
6,435,968 B1 8/2002 Torango
6,439,995 B1 8/2002 Hughs-Baird et al.
6,454,650 B1 9/2002 Aronin
6,482,089 B2 11/2002 DeMar et al.
6,488,580 B1 12/2002 Robb
6,488,585 B1 12/2002 Wells et al.
6,503,146 B2 1/2003 Walker et al.
6,506,117 B2 1/2003 DeMar et al.
6,508,707 B2 1/2003 DeMar et al.
6,508,709 B1 1/2003 Karmarkar
6,508,710 B1 1/2003 Paravia et al.
6,517,073 B1 2/2003 Vancura
6,517,433 B2 2/2003 Loose et al.
6,520,855 B2 2/2003 DeMar et al.
6,523,124 B1 2/2003 Lunsford et al.
6,527,638 B1 3/2003 Walker et al.
6,560,639 B1 5/2003 Dan et al.
6,589,115 B2 7/2003 Walker et al.
6,592,460 B2 7/2003 Torango
6,599,186 B1 7/2003 Walker et al.
6,599,188 B2 7/2003 Hirsch et al.
6,599,193 B2 7/2003 Baerlocher et al.
6,628,939 B2 9/2003 Paulsen

(56) References Cited

U.S. PATENT DOCUMENTS 6,648,753 B1 11/2003 Tracy et al.
6,648,762 B2 11/2003 Walker et al.
6,652,378 B2 11/2003 Cannon et al.
6,665,715 B1 12/2003 Houri
6,676,522 B2 1/2004 Rowe et al.
6,682,421 B1 1/2004 Rowe et al.
6,692,354 B2 2/2004 Tracy et al.
6,712,695 B2 3/2004 Mothwurf et al.
6,712,699 B2 3/2004 Walker et al.
6,733,390 B2 5/2004 Walker et al.
6,749,510 B2 6/2004 Giobbi
6,755,741 B1 6/2004 Rafaeli
6,761,637 B2 7/2004 Weston et al.
6,790,141 B2 9/2004 Muir
6,800,029 B2 10/2004 Rowe et al.
6,805,634 B1 10/2004 Wells et al.
6,837,788 B2 1/2005 Cannon
6,837,793 B2 1/2005 McClintic
6,843,725 B2 1/2005 Nelson
6,846,238 B2 1/2005 Wells
6,860,810 B2 3/2005 Cannon et al.
6,869,361 B2 3/2005 Sharpless et al.
6,887,151 B2 5/2005 Leen et al.
6,923,724 B2 8/2005 Williams
6,935,952 B2 8/2005 Walker et al.
6,955,604 B1 10/2005 Graves et al.
6,971,956 B2 12/2005 Rowe et al.
6,986,055 B2 1/2006 Carlson
7,008,319 B2 3/2006 Montgomery et al.
7,083,520 B2 8/2006 Rowe
7,097,562 B2 8/2006 Gagner
7,169,041 B2 1/2007 Tessmer et al.
7,175,527 B2 2/2007 Bryant
7,192,351 B2 3/2007 Rozkin et al.
7,260,834 B1 8/2007 Carlson
7,311,598 B2 12/2007 Kaminkow et al.
7,311,604 B2 12/2007 Kaminkow et al.
7,331,868 B2 2/2008 Beaulieu et al.
7,347,775 B2 3/2008 Roemer
7,427,236 B2 9/2008 Kaminkow et al.
7,448,949 B2 11/2008 Kaminkow et al.
7,476,153 B2 1/2009 Walker et al.
7,487,112 B2 2/2009 Barnes, Jr.
7,510,474 B2 3/2009 Carter, Sr.
7,534,169 B2 5/2009 Amaitis et al.
7,549,576 B2 6/2009 Alderucci et al.
7,637,810 B2 12/2009 Amaitis et al.
7,662,040 B2 2/2010 Englman et al.
7,666,092 B2 2/2010 Kaminkow et al.
7,722,466 B2 5/2010 Rothschild
7,775,873 B2 8/2010 Aoki et al.
7,780,531 B2 8/2010 Englman et al.
7,833,094 B2 11/2010 Englman et al.
7,854,654 B2 12/2010 Baerlocher et al.
7,892,093 B2 2/2011 Kniesteadt
7,931,530 B2 4/2011 Anderson et al.
7,963,847 B2 6/2011 Baerlocher
7,980,954 B2 7/2011 Gagner et al.
8,152,634 B2 4/2012 Gagner et al.
8,162,750 B2 4/2012 Gagner et al.
8,216,048 B2 7/2012 Cowan et al.
8,229,458 B2 * 7/2012 Busch ..... 455/456.1
8,262,456 B2 9/2012 Englman et al.
8,282,465 B2 10/2012 Giobbi
8,282,490 B2 10/2012 Arezina et al.
8,287,383 B1 10/2012 Etter et al.
8,287,384 B2 10/2012 Auterio et al.
8,292,731 B2 10/2012 Collette et al.
8,292,743 B1 10/2012 Etter et al.
8,303,402 B2 11/2012 Aoki et al.
8,409,014 B2 4/2013 Gagner et al.
8,449,387 B2 5/2013 Englman et al.
8,772,509 B2 7/2014 Lindsley et al.
2001/0004606 A1 6/2001 Tracy et al.
2001/0044339 A1 11/2001 Cordero et al.
2002/0002073 A1 1/2002 Montgomery et al.
2002/0006822 A1 1/2002 Krintzman
2002/0025845 A1 2/2002 Cannon
2002/0032049 A1 3/2002 Walker et al.
2002/0037767 A1 3/2002 Ebin
2002/0068631 A1 6/2002 Raverdy et al.
2002/0073043 A1 6/2002 Herman et al.
2002/0086729 A1 7/2002 Emmerson et al.
2002/0087876 A1 7/2002 Larose
2002/0098888 A1 7/2002 Rowe et al.
2002/0107072 A1 8/2002 Giobbi
2002/0116615 A1 8/2002 Nguyen et al.
2002/0128057 A1 * 9/2002 Walker et al. ..... 463/20
2002/0138594 A1 9/2002 Rowe
2002/0142846 A1 10/2002 Paulsen
2002/0147047 A1 10/2002 Letovsky et al.
2002/0147049 A1 10/2002 Carter, Sr.
2002/0151345 A1 10/2002 Byrne
2002/0151349 A1 10/2002 Joshi
2002/0151363 A1 10/2002 Letovsky et al.
2002/0155874 A1 10/2002 Byrne
2002/0155887 A1 10/2002 Criss-Puszkiewicz et al.
2002/0163778 A1 11/2002 Hazzard et al.
2002/0183105 A1 12/2002 Cannon et al.
2002/0183107 A1 12/2002 Wolfe
2003/0006931 A1 1/2003 Mages
2003/0008703 A1 1/2003 Gauselmann
2003/0027618 A1 2/2003 Byrne
2003/0028567 A1 2/2003 Carlson
2003/0032474 A1 2/2003 Kaminkow
2003/0032485 A1 2/2003 Cockerille
2003/0036430 A1 2/2003 Cannon
2003/0045337 A1 3/2003 Byrne
2003/0050106 A1 3/2003 Lyfoung
2003/0054868 A1 3/2003 Paulsen et al.
2003/0054878 A1 3/2003 Benoy et al.
2003/0060258 A1 3/2003 Coleman et al.
2003/0064771 A1 4/2003 Morrow et al.
2003/0064776 A1 4/2003 Byrne
2003/0064805 A1 4/2003 Wells
2003/0064807 A1 4/2003 Walker et al.
2003/0092485 A1 5/2003 Seelig et al.
2003/0100361 A1 5/2003 Sharpless et al.
2003/0104865 A1 6/2003 Itkis et al.
2003/0114220 A1 6/2003 McClintic
2003/0119581 A1 6/2003 Cannon et al.
2003/0130026 A1 7/2003 Breckner et al.
2003/0139190 A1 7/2003 Steelberg et al.
2003/0148804 A1 8/2003 Ikeya et al.
2003/0148807 A1 8/2003 Acres
2003/0148808 A1 8/2003 Price
2003/0162589 A1 8/2003 Nguyen et al.
2003/0181231 A1 9/2003 Vancura et al.
2003/0186733 A1 10/2003 Wolf et al.
2003/0195043 A1 10/2003 Shinners et al.
2003/0195841 A1 10/2003 Ginsberg et al.
2003/0216166 A1 11/2003 Baerlocher et al.
2003/0222402 A1 12/2003 Olive
2003/0224852 A1 12/2003 Walker et al.
2003/0224855 A1 12/2003 Cunningham
2003/0228899 A1 12/2003 Evans
2003/0232651 A1 12/2003 Huard et al.
2003/0236116 A1 12/2003 Marks et al.
2004/0009808 A1 1/2004 Gauselmann
2004/0009811 A1 1/2004 Torango
2004/0030654 A1 2/2004 Walker et al.
2004/0038741 A1 2/2004 Gauselmann
2004/0048644 A1 3/2004 Gerrard et al.
2004/0053657 A1 3/2004 Fiden et al.
2004/0087370 A1 5/2004 Tarantino
2004/0102243 A1 5/2004 Olsen
2004/0106448 A1 6/2004 Gauselmann
2004/0137987 A1 7/2004 Nguyen et al.
2004/0140989 A1 7/2004 Papageorge
2004/0162124 A1 8/2004 Barton
2004/0193431 A1 9/2004 Campbell
2004/0204226 A1 10/2004 Foster et al.
2004/0204235 A1 10/2004 Walker et al.
2004/0209660 A1 10/2004 Carlson et al.

(56) References Cited

U.S. PATENT DOCUMENTS

2004/0224769 A1 11/2004 Hansen et al.
2004/0235552 A1 11/2004 Gauselmann
2004/0242297 A1 12/2004 Walker et al.
2004/0242303 A1 12/2004 Walker et al.
2004/0248651 A1 12/2004 Gagner
2005/0003883 A1 1/2005 Muir et al.
2005/0009600 A1 1/2005 Rowe et al.
2005/0014554 A1 1/2005 Walker et al.
2005/0020340 A1 1/2005 Cannon
2005/0026674 A1 2/2005 Wolf et al.
2005/0026697 A1 2/2005 Balahura et al.
2005/0037708 A1 2/2005 Torvinen
2005/0055113 A1 3/2005 Gauselmann
2005/0124406 A1 6/2005 Cannon
2005/0130728 A1 6/2005 Nguyen et al.
2005/0130730 A1 6/2005 Lind et al.
2005/0153768 A1* 7/2005 Paulsen ..... 463/16
2005/0187020 A1 8/2005 Amaitis et al.
2005/0192086 A1 9/2005 Walker et al.
2005/0193209 A1 9/2005 Saunders et al.
2005/0197190 A1 9/2005 Amaitis et al.
2005/0227770 A1 10/2005 Papulov
2005/0282605 A1 12/2005 Englman et al.
2006/0019734 A1 1/2006 Roemer
2006/0019744 A1 1/2006 Roemer
2006/0019745 A1 1/2006 Benbrahim
2006/0035707 A1 2/2006 Nguyen et al.
2006/0040732 A1 2/2006 Baerlocher et al.
2006/0079318 A1 4/2006 Aoki et al.
2006/0079319 A1 4/2006 Aoki et al.
2006/0084486 A1 4/2006 Belger et al.
2006/0121971 A1 6/2006 Slomiany et al.
2006/0135243 A1 6/2006 Englman et al.
2006/0160625 A1 7/2006 Englman et al.
2006/0165235 A1 7/2006 Carlson
2006/0189382 A1 8/2006 Muir et al.
2006/0223611 A1 10/2006 Baerlocher et al.
2007/0021198 A1 1/2007 Muir et al.
2007/0054739 A1 3/2007 Amaitis et al.
2007/0060305 A1 3/2007 Amaitis et al.
2007/0060306 A1 3/2007 Amaitis et al.
2007/0060355 A1 3/2007 Amaitis et al.
2007/0060358 A1 3/2007 Amaitis et al.
2007/0066401 A1 3/2007 Amaitis et al.
2007/0066402 A1 3/2007 Amaitis et al.
2007/0077981 A1* 4/2007 Hungate et al. ..... 463/16
2007/0117623 A1* 5/2007 Nelson et al. ..... 463/29
2007/0243928 A1* 10/2007 Iddings ..... 463/26
2007/0275779 A1 11/2007 Amaitis et al.
2007/0281782 A1 12/2007 Amaitis et al.
2007/0281785 A1 12/2007 Amaitis et al.
2007/0281792 A1 12/2007 Amaitis et al.
2008/0020847 A1 1/2008 Kniesteadt et al.
2008/0045341 A1 2/2008 Englman
2008/0070702 A1 3/2008 Kaminkow et al.
2008/0076512 A1 3/2008 Aida
2008/0076572 A1 3/2008 Nguyen et al.
2008/0081690 A1 4/2008 Baerlocher et al.
2008/0113771 A1 5/2008 Baerlocher et al.
2008/0139290 A1 6/2008 Kniesteadt et al.
2008/0139306 A1 6/2008 Lutnick et al.
2008/0153564 A1 6/2008 Baerlocher et al.
2008/0167106 A1* 7/2008 Lutnick et al. ..... 463/16
2008/0300046 A1 12/2008 Gagner et al.
2008/0311994 A1 12/2008 Amaitis et al.
2009/0029780 A1* 1/2009 Amaitis et al. ..... 463/43
2009/0093298 A1 4/2009 Michel
2009/0124366 A1 5/2009 Aoki et al.
2009/0162245 A1 6/2009 Rasmussen
2009/0170596 A1 7/2009 Gagner et al.
2009/0170597 A1 7/2009 Bone et al.
2009/0176559 A1 7/2009 Buchholz et al.
2009/0197684 A1* 8/2009 Arezina et al. ..... 463/42
2009/0203448 A1 8/2009 Lupo et al.
2009/0247285 A1 10/2009 Gagner
2009/0280910 A1 11/2009 Gagner et al.
2009/0305765 A1 12/2009 Walker et al.
2010/0016075 A1 1/2010 Thomas
2010/0137047 A1 6/2010 Englman et al.
2010/0137053 A1 6/2010 Blair et al.
2010/0197385 A1 8/2010 Aoki et al.
2010/0279665 A1 11/2010 Hardin et al.
2010/0291991 A1 11/2010 Baerlocher et al.
2010/0304843 A1 12/2010 Aoki et al.
2010/0311496 A1 12/2010 Taylor et al.
2011/0053683 A1 3/2011 Aoki et al.
2011/0105233 A1 5/2011 Aoki
2011/0112892 A1 5/2011 Tarantino
2011/0143834 A1 6/2011 Guinn et al.
2011/0250960 A1 10/2011 Nguyen
2011/0306400 A1 12/2011 Nguyen
2011/0312410 A1 12/2011 Aoki et al.
2012/0004018 A1 1/2012 Reeves, III
2012/0046096 A1 2/2012 Morrison et al.
2012/0214571 A1 8/2012 Oakes et al.
2012/0276990 A1 11/2012 Arezina et al.
2012/0315978 A1* 12/2012 LeMay et al. ..... 463/25
2013/0005447 A1 1/2013 Lutnick et al.
2013/0006773 A1 1/2013 Lutnick et al.
2013/0072280 A1 3/2013 Yacenda
2013/0073473 A1* 3/2013 Heath ..... 705/319
2013/0116028 A1 5/2013 Aoki et al.
2013/0217473 A1 8/2013 Oakes et al.
2013/0237304 A1 9/2013 Oakes et al.
2013/0324219 A1 12/2013 Vann

OTHER PUBLICATIONS

U.S. Appl. No. 13/777,474, filed Feb. 26, 2013, Vann, Jamie W.
"U.S. Appl. No. 13/777,474 Office Action", Nov. 27, 2013 , 19 Pages.
"U.S. Appl. No. 13/777,474 Final Office Action", Nov. 5, 2014, 8 pages.
"U.S. Appl. No. 13/777,474 Final Office Action", Apr. 3, 2014, 11 Pages.
"U.S. Appl. No. 13/777,474 Office Action", Apr. 2, 2015, 16 Pages.
"U.S. Appl. No. 13/777,474 Office Action", Jul. 29, 2014, 7 Pages.
"U.S. Appl. No. 13/777,474 Final Office Action", Nov. 18, 2015, 15 Pages.

* cited by examiner

WAGERING GAME CONTENT BASED ON LOCATIONS OF PLAYER CHECK-IN

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

FIELD

Embodiments of the inventive subject matter relate generally to wagering game systems, and more particularly to wagering game systems including modified wagering game content based on locations of player check-in.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments of the invention are illustrated in the Figures of the accompanying drawings in which.

DESCRIPTION OF THE EMBODIMENTS

Figure 1:
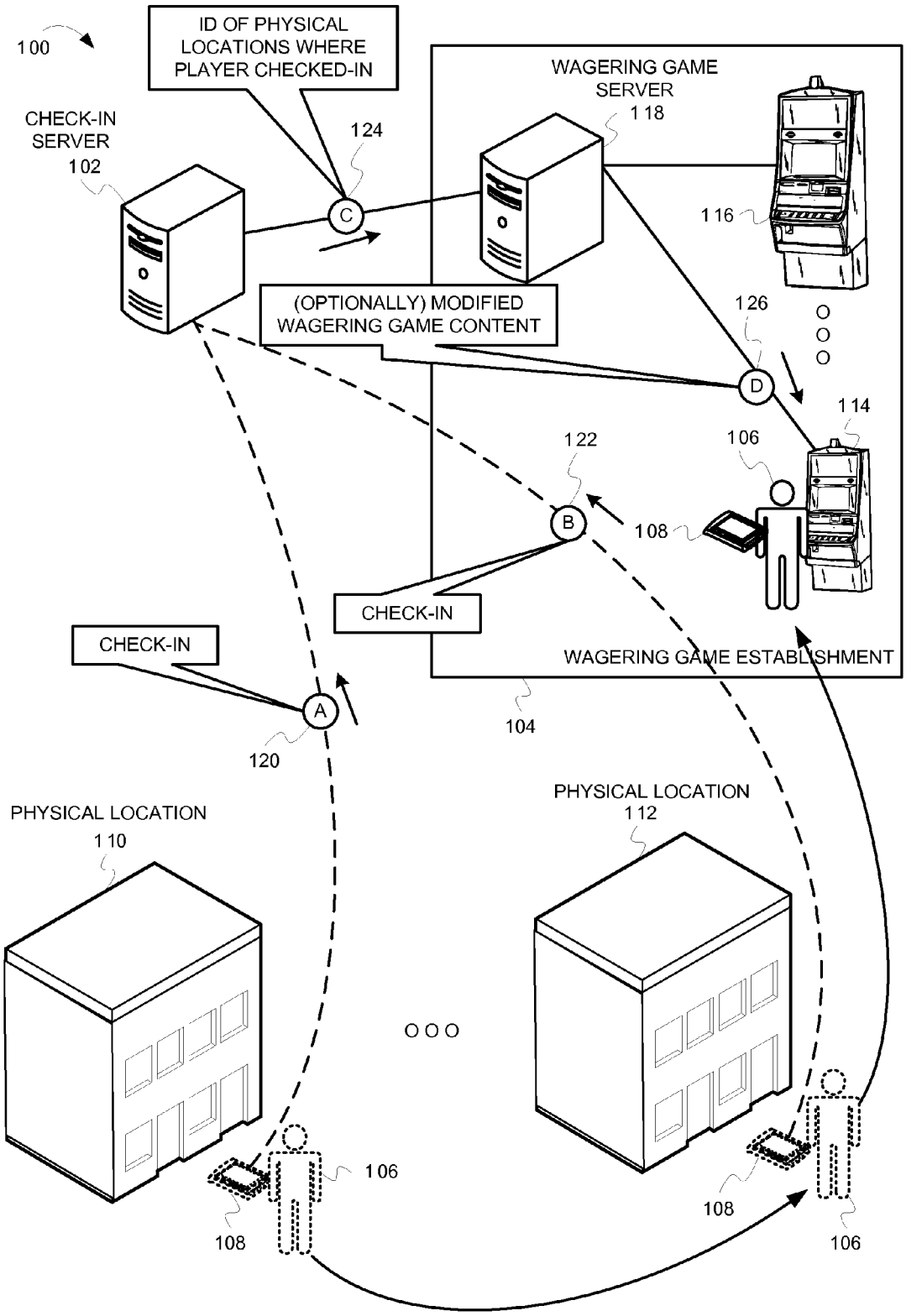
FIG. 1 depicts a system that provides modified wagering game content for wagering games based on physical locations where the wagering game player has checked-in, according to some embodiments.

This description of the embodiments is divided into six sections. The first section provides an introduction to some embodiments, while the second section provides a system environment. The third section describes example operations performed by some embodiments. The fourth section describes an example wagering game machine architecture and network environment. The fifth section describes an example wagering game machine and the sixth section presents some general comments.

Introduction

This section provides an introduction to some embodiments. In some embodiments, wagering game content is modified based on physical locations where a wagering game player has checked-in. For example, the wagering game player can check-in at different physical locations (e.g., different retail stores) using a mobile application on their mobile device (e.g., mobile phone) before playing the wagering game.

These physical locations may or may not be associated with wagering game activity. For example, these physical locations can include coffee shops, restaurants, public parks, cities, various landmarks in a city, wagering game establishments, specific machines in wagering game establishments, etc. As part of a check-in process, the mobile device can transmit an identification of the wagering game player and the player's physical location to a remote server using, for example, wireless communications. Later, when the wagering game player is at a wagering game machine (or other device for playing a wagering game), wagering game content can be modified based on the physical locations that the player visited.

An example process for providing modified content to wagering game machines may work as follows. After the player has logged into the wagering game machine, the wagering game machine can transmit the player's identification to a wagering game server. In response, the remote server can provide, to the wagering game machine, physical locations that the player has visited. Additionally, the remote server can provide the modified wagering game content to the wagering game machine (if the modified wagering game content is not already stored in the wagering game machine).

The wagering game player can then play the wagering game based on the modified wagering game content. The modified wagering game content can affect aspects of the game's presentation (e.g., images, video, audio, etc.). For example, if the wagering game is a slots game, one or more of the reel symbols can be modified to represent the physical locations visited by the player. For example, the physical locations can be associated with a business entity, a government entity, a geographic location, etc. In such configurations, the modified wagering game content can be graphics or images that represent the associated business entity, government entity, geographic location, etc. Additionally, the modified wagering game content can affect play of the wagering game. For example, the expected value (EV) (i.e., the theoretical average payout) of the wagering game can be increased based on the modified wagering game content. To illustrate this for slots games, bonuses can be added, reel symbols can be changed from a non-wild symbol to a wild symbol, etc. As a result, the modified content can increase a wagering game's EV. In addition to slots games, other types of wagering games can include dice games, card games, spinning wheel games, etc. In some embodiments, the modified wagering game content can affect items other than the wagering game itself. For example, the modified wagering game content can include the graphics for the button panels, the background of the game, different animations in the main or secondary displays, etc. Some embodiments are applicable to both online wagering games (e.g., internet-based wagering game websites) and wagering games on wagering game machines at brick-and-mortar wagering game establishments. Additionally, the wagering games can be played online via a mobile device. For example, the mobile device that is used for checking-in can also be used for playing the online wagering games. Also, wagering can include wagering of real money, "fun" money, or anything else of real or perceived value on an event with an uncertain outcome.

System Environment

FIG. 1 depicts a system that provides modified wagering game content for wagering games based on physical locations where the wagering game player has checked-in, according to some embodiments. A system 100 can modify wagering game content based on physical locations where a wagering game player has checked-in. For example, the wagering game player can check-in at different physical locations (e.g., different retail stores) using a mobile application on their mobile devices prior to playing the wagering game.

FIG. 1 shows a wagering game establishment 104. The system 100 includes a check-in server 102, wagering game machines 114-116, and a wagering game server 188. These components are connected via a computer network. In FIG. 1, the wagering game machine 114 presents the wagering game in the wagering game establishment 104. However, the wagering game can be presented on any type of device (including devices outside wagering game establishments, as described above).

FIG. 1 also shows physical locations 110-112. While shown as buildings in FIG. 1, the physical locations can be any location where a wagering game player checks-in. For example, the physical locations can include coffee shops, restaurants, public parks, cities, various landmarks in a city, wagering game establishments, specific machines in wagering game establishments, etc. As shown in FIG. 1, a wagering game player 106 has a mobile device 108. Also in this example, the wagering game player 106 is shown moving to different physical locations and finally to the wagering game machine 114.

Figure 3:
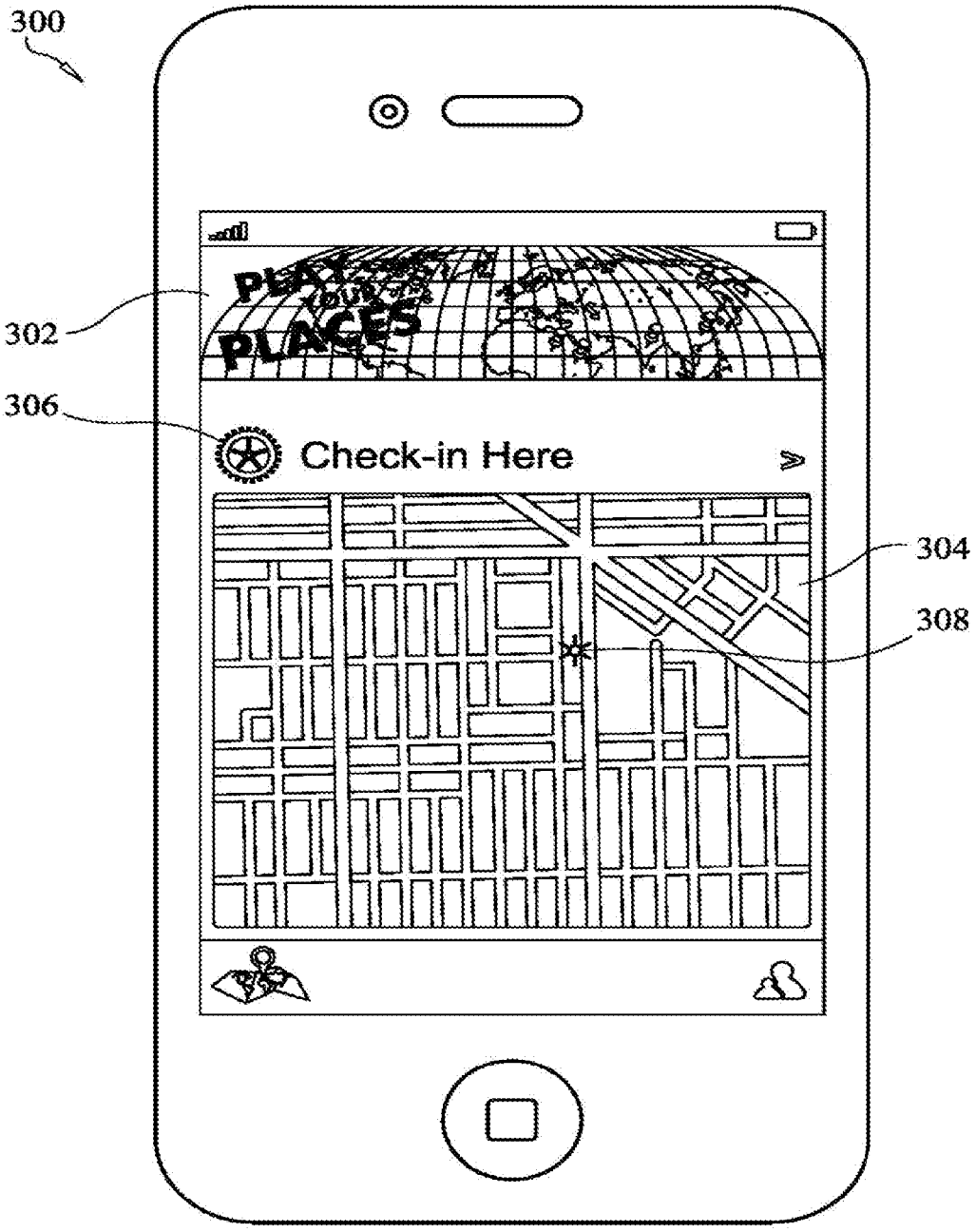
FIGS. 3-4 depict a mobile device executing a mobile application, according to some embodiments.
Figure 4:
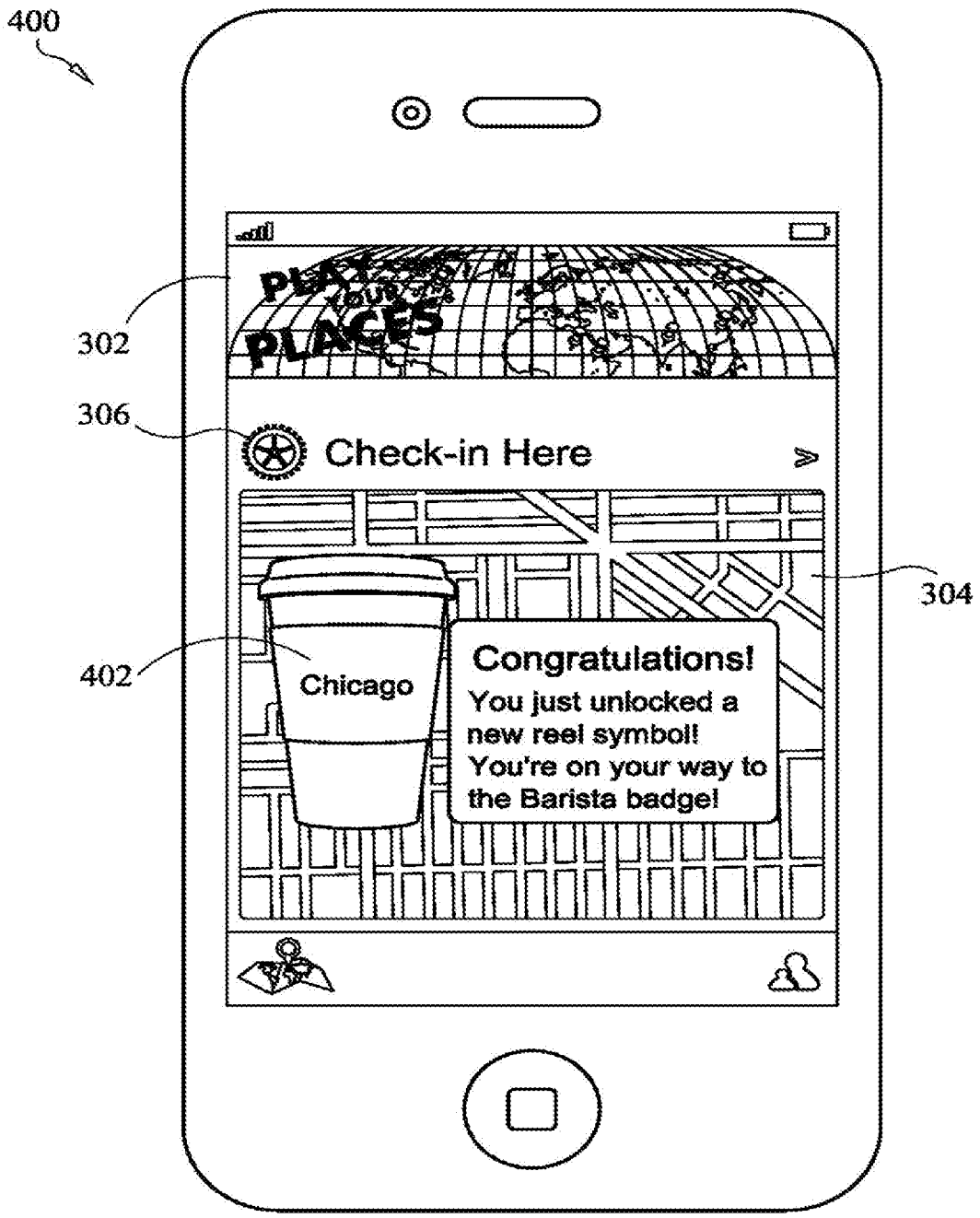

Initially, the wagering game player 106 is near the physical location 110. Also, the wagering game player 106 checks-in using an application on their mobile device 108. An example of such a mobile application on a mobile device is illustrated in FIGS. 3-4, which are described in more detail below. The mobile application can provide a list of physical locations near the wagering game player 106, based on the Global Positioning System (GPS) coordinates provided by the mobile device 108. The wagering game player 106 can then select a physical location (among a list of physical locations) for checking-in. In FIG. 1, the wagering game player 106 selects the physical location 110 from a list of physical locations displayed on the mobile device 108. In response to the selection, the mobile device 108 wirelessly transmits a check-in transmission 120 to the check-in server 102. The check-in transmission 120 can include the identification of the physical location 110 and the identification of the wagering game player 106.

After checking in at location 110, the wagering game player 106 moves near the physical location 112. Using the mobile application on the mobile device 108, the wagering game player 106 checks-in at the physical location 112. The wagering game player 106 selects the physical location 112 from a list of physical locations displayed on the mobile device 108. In response to the selection, the mobile device 108 wirelessly transmits a check-in transmission 122 to the check-in server 102. The check-in transmission 122 can include the identification of the physical location 112 and the identification of the wagering game player 106. While FIG. 1 shows the player 106 checking-in at two physical locations, the player can check-in at any number of physical locations, and can also check-in at the same physical location multiple times.

After receiving the physical locations and player identification, the check-in server 102 transmits this data to the wagering game server 118—shown as a transmission 124. In some embodiments, the check-in server 102 can provide this data periodically and/or upon demand by the wagering game server 118. For example, the wagering game server 118 can request this data for a particular wagering game player after the player has logged into a wagering game machine at the wagering game establishment 104.

As shown, the wagering game player 106 next moves to play the wagering game machine 114. The wagering game player 106 may log into a player account at the wagering game machine 114. The system can modify wagering game content used for presenting a wagering game on the wagering game machine 114 based on player's identification and physical locations where the player checked-in. In some embodiments, the wagering game server 118 can transmit the modified wagering game content to the wagering game machine 114. Alternatively, the wagering game module in the wagering game machine 114 can retrieve the modified wagering game content from local machine-readable media therein.

The modified wagering game content can affect different aspects of the presentation layer (e.g., images, video, audio, etc.). For example, if the wagering game is a slots game, one or more of the reel symbols can be modified to represent the physical locations visited by the player. For example, the physical locations can be associated with a business entity, a government entity, a geographic location, etc. In such configurations, the modified wagering game content can be graphics or images that represent the associated business entity, government entity, geographic location, etc. Additionally, the modified wagering game content can affect play of the wagering game. For example, the expected value of the wagering game can be increased based on the modified wagering game content. For slots games, bonuses can be added, reel symbols can be changed from a non-wild symbol to a wild symbol, etc.

In some embodiments, one or more check-ins at a particular physical location can trigger, in the wagering game, a bonus associated with that location. For example, after the player has checked-in ten times at a coffee shop, the wagering game presents a bonus game having content associated with the coffee shop. The new bonus game can be configured to affect or not affect the existing overall expected value (EV) of the wagering game. For example, this new bonus can replace an existing bonus in the wagering game and have the same EV as the existing bonus, thereby not affecting the overall EV of the wagering game. Alternatively, this new bonus and its associated EV can be added to the wagering game, thereby increasing the overall EV.

In some embodiments, an entity associated with a physical location can be a sponsor of modified wagering game content (e.g., a bonus). That is, the sponsor may provide value to wagering game providers (e.g. casinos) to pay for increases in EV (if any), and for the gaming content that promotes the sponsor's physical location (e.g. a retail store). In return, the sponsor receives the advertising value associated with the modified wagering game content. For example, the sponsor's corporate logo, product graphics, etc. may be added to the wagering game to promote the sponsor. In some embodiments, as part of a sponsored bonus, the sponsor can provide a non-cash award, such as a coupon. For example, the coupons can provide free or discounted items at a particular coffee shop. This award can be in lieu of or in addition to a monetary result for a bonus game.

In some embodiments, the amount of modified wagering game content added to a wagering game is based on the number of check-ins by a player at a particular physical location. For example, in a slot game, a reel symbol is replaced for each time a player checks-in at a location. The replacement symbols can include images associated with the location, sponsor, etc. Also, there can be a maximum number of these reel symbols that are replaced. For example, a maximum of one symbol per reel can be modified to represent the physical location. Therefore, if there are five reels, a maximum of five reel symbols can be modified (one for each reel) to represent the physical location, in response to five different check-ins by the player at the location.

In some embodiments, a mobile device is not required for check-in at a physical location. For example, a player loyalty program can provide player account login information at different locations (e.g., different wagering game machines at wagering game establishments). Also, the player's physical location can be determined based on the network address (e.g., Media Access Control (MAC) address) of the wagering game machine where the player is logged in. The network address can be cross-referenced with a database of network addresses for the different wagering game machines. This cross-reference can determine the player's location. To illustrate, a player check-in is considered complete after the player logs into their player account and wagers at a wagering game machine. These check-ins at different wagering game machines can then provide for modified wagering game content for a wagering game (at these machines or other wagering game machines).

In some embodiments, the wagering game is a slots game. For a slots game, a pay table defines a hierarchy of payouts for winning combinations of the reel symbols (from low to high). For example, a winning combination of matching cherry reel symbols would be a lowest payout; a winning combination of matching orange reel symbols would be a second lowest payout; a winning combination of matching 7's would be a higher payout, etc. In some embodiments, the number of player check-ins to a physical location modifies the symbol hierarchy for the reel symbols in the slots game. This modification can be through replacement or watermarking of an existing reel symbol. To illustrate, if the player has checked-in at the physical location 112 in a range of 1 to 5 times, the reel symbol having the lowest payout in the symbol hierarchy is replaced or watermarked with images representing the physical location 112. If the player has checked-in at the physical location 112 in a range of 6 to 20 times, the reel symbol having the second lowest payout in the symbol hierarchy is replaced or watermarked with images representing the physical location 112. If the player has checked-in at the physical location 112 in a range of 21 to 50 times, the reel symbol having the third lowest payout in the symbol hierarchy is replaced or watermarked with images representing the physical location 112. This progression can continue to the top of the symbol hierarchy. At the top of the hierarchy, the winning combination based on reel symbols representing the physical location 112 can trigger a bonus game in the wagering game. An existing bonus game is replaced by a bonus game representing the physical location 112 (e.g., different indicia presenting the physical location 112, payouts defined relative to gift cards, coupons, etc. for the physical location 112, etc.). These ranges of check-ins can be defined to enable the replacement or watermarking of the different reel symbols within the hierarchy. As described above, in some embodiments, if the player achieves a winning combination of reel symbols representing the physical location or wins in the bonus game representing the physical location, the player can win prizes (e.g., coupons for the business entity). These prizes can be in lieu of or in addition to the traditional monetary payout associated with the reel symbol that was replaced.

Players may have checked-in at different physical locations (e.g., locations for two different business entities) that can modify the wagering game content. In some embodiments, the player can select which of the multiple physical locations are to be represented in the wagering game based on the modified wagering game content. In such embodiments, check-ins at only one but not both physical locations modify the wagering game content. However in some other example embodiments, check-ins at any number of different physical locations modify the wagering game content.

In some embodiments, the wagering game player may be required to check-in at multiple physical locations to access particular modified wagering game content. For example, the wagering game player may be required to check-in at the top 10 landmarks for a city to access modified wagering game content related to the city (e.g., a reel symbol that represents the city). In some embodiments, repeated check-ins at the same physical location enable the wagering game player to receive a leadership badge for that location (e.g., mayorship, governorship, presidencies, etc.). The modified wagering game content can relate to this leadership. For example, the modified wagering game content can include a reel symbol that includes an image indicative of the leadership earned.

In some embodiments, as the number of check-ins for a particular physical location varies (e.g., increases) the modified wagering game content also varies. For example, assume that the modified wagering game content includes a reel symbol. If the number of check-ins exceeds a defined value, the reel symbol is converted into a wild symbol or into a symbol that covers multiple spots on the reel.

Figure 2:
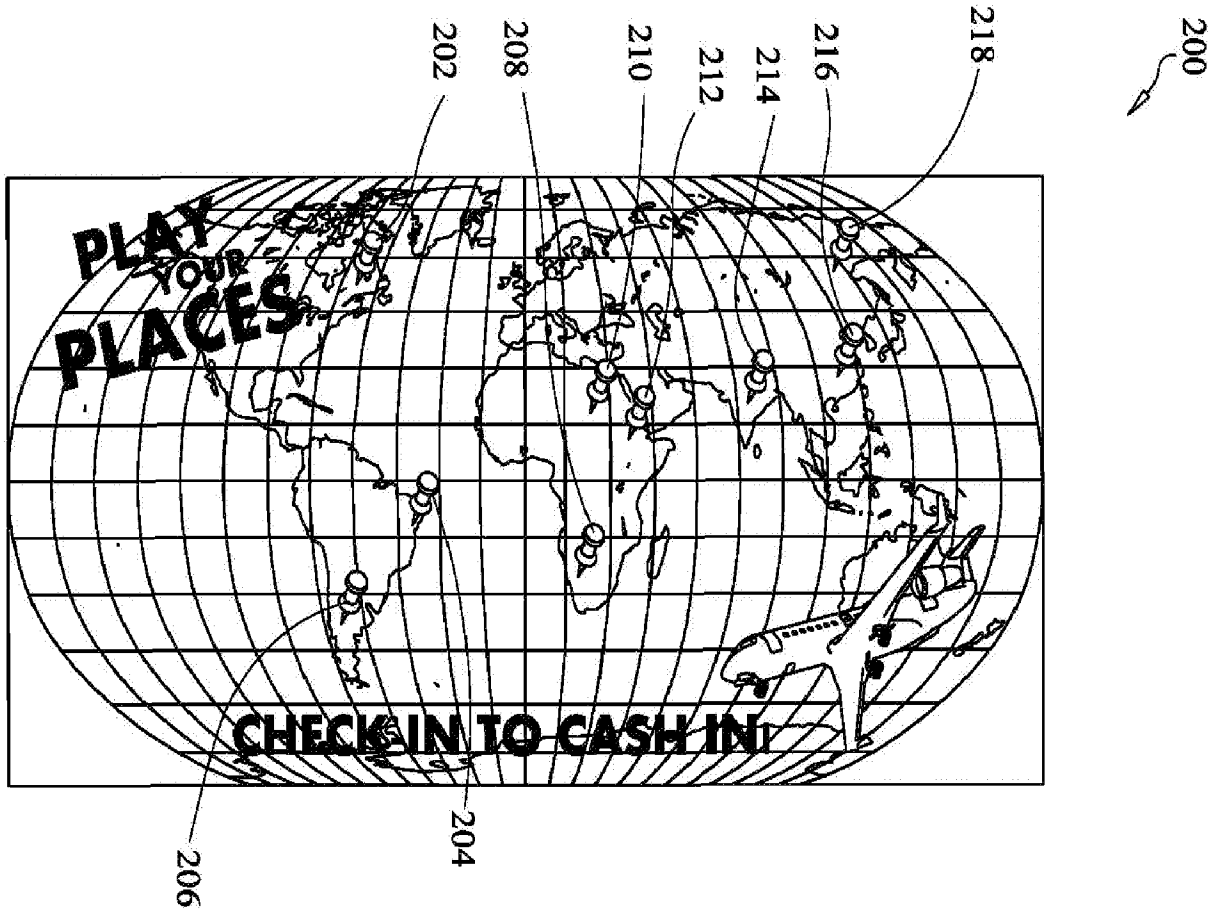
FIG. 2 depicts a screenshot of a mobile application for a mobile device, according to some embodiments.

FIG. 2 depicts a screenshot of a mobile application for a mobile device, according to some embodiments. FIG. 2 depicts a screenshot 200 that can be presented on a mobile device's display device after a wagering game player initiates the mobile application. The screenshot 200 includes a global map with a number of push pins (push pins 202-218). In some embodiments, instead of a global map, the map can be a regional map (e.g., map of the United States) that provides a Graphical User Interface (GUI) indicating where the wagering game player has actually checked-in. Accordingly, the push pins 202-218 can represent the physical locations where the wagering game player has checked in.

FIGS. 3-4 depict a mobile device executing a mobile application, according to some embodiments. FIG. 3 depicts a mobile device 300 with a screen displaying a mobile application prior to a check-in by the wagering game player. FIG. 4 depicts the mobile device 300 after the check-in.

The mobile device 300 includes a screen 302 for displaying a visual output for the mobile application used for player check-in (as described above). The display of the mobile application includes a map 304 to enable the wagering game player to see where they are currently located. The map 304 displays a current location 308 of the mobile device 300. The display of the mobile application also includes a check-in button 306. After the wagering game player has arrived at a physical location on the map 304 where they want to check-in, they can select the check-in button 306. In response, the mobile application can provide a list of possible physical locations relative to the current GPS coordinates for the mobile device 300 (as described above). The wagering game player can select a physical location for checking-in based on the list.

FIG. 4 depicts the mobile device 300 after the wagering game player has selected the physical location for checking-in. In response, a graphic 402 is overlaid on the map 304 that notifies the wagering game player that they have unlocked a new reel symbol for a wagering game based on their check-in. In this example as shown by the graphic 402, the physical location is a coffee shop in Chicago. The graphic 402 also notifies the wagering game player that they are progressing to achieving a "Barista badge" for the coffee shop based on repeated check-ins.

Figure 5:
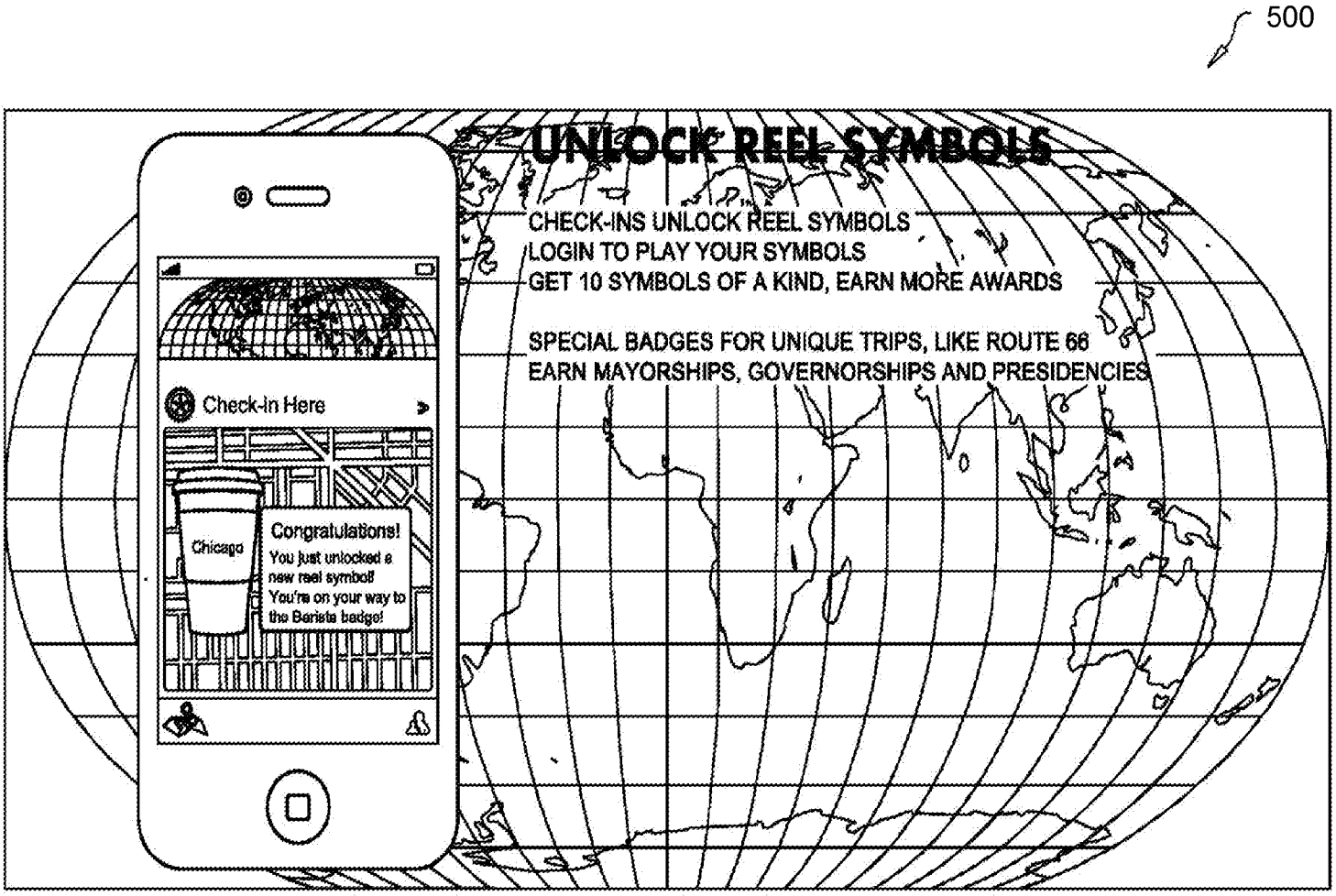
FIG. 5 depicts a screenshot of a wagering game for describing the check-in feature, according to some embodiments.

FIG. 5 depicts a screenshot of a wagering game for describing the check-in feature, according to some embodiments. A screenshot 500 is displayed to notify the wagering game player of the ability to modify the wagering game content for the wagering game and some advantages of doing so. In particular, the screenshot 500 notifies the wagering game player that check-ins unlock new reel symbols and the wagering game players are required to login to their player account at the wagering game to play these symbols. The screenshot 500 also displays a notification that the wagering game player can earn more awards by getting 10 symbols of a kind. The screenshot 500 displays a notification that the wagering game player can earn special badges as part of checking-in at multiple locations for unique trips (e.g., Route 66). The screenshot 500 also displays a notification that the wagering game player can earn mayorships, governorships, and presidencies for a physical location based on repeated check-ins at the physical location. Also, as noted above, the modified wagering game content can include these special badges for unique trips, mayorships, governorships, and presidencies.

Figure 6:
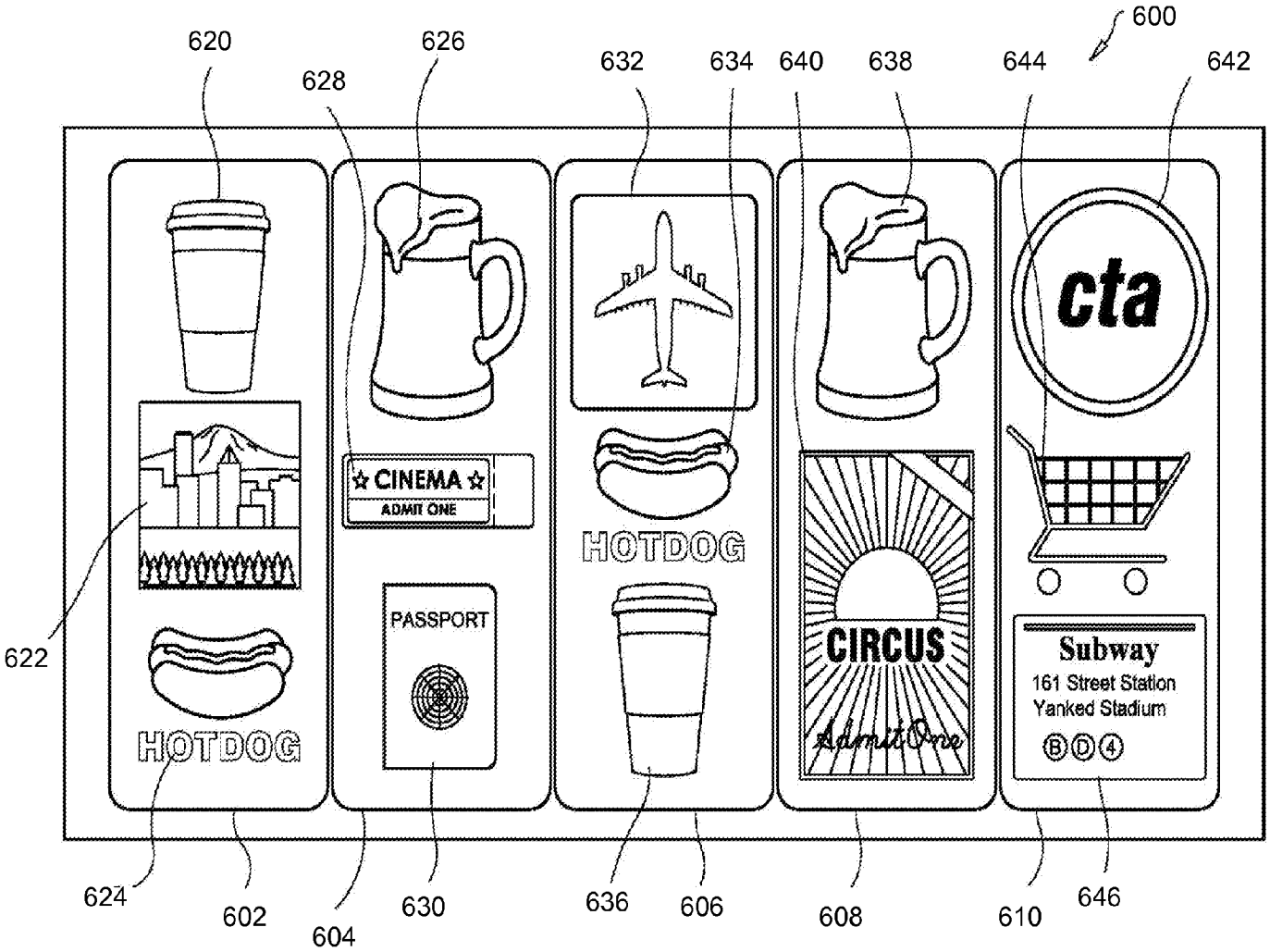
FIG. 6 depicts a screenshot of a base-game screen for a wagering game that includes modified wagering game content, according to some embodiments.

FIG. 6 depicts a screenshot of a base-game screen for a wagering game that includes modified wagering game content, according to some embodiments. A screenshot 600 includes a number of reel symbols that are examples of modified wagering game content. The screenshot 600 displays five different reels (reels 602-610). The reel 602 displays reel symbols 620-624. The reel 604 displays reel symbols 626-630. The reel 606 displays reel symbols 632-636. The reel 608 displays reel symbols 638-640. The reel 610 displays reel symbols 642-646. The reel symbols 620-646 represent different physical locations (including business entities, government entities, cites, etc.). In this example, all of the reel symbols shown include modified wagering game content for different physical locations. As described above, one to any number of physical locations can be represented by modified wagering game content based on player check-in. Also in some embodiments, not all of the reel symbols are replaced as modified wagering game content. Rather, only a portion of the reel symbols are new such that the new reel symbols are integrated with existing reel symbols on the reels.

The reel symbols 620 and 638 include a display of a coffee cup that represents a coffee shop. The reel symbol 622 includes a display of a graphic that represents the city of Seattle, Wash. The reel symbols 624 and 634 include a display of a hot dog that represents a restaurant that serves hot dogs. The reel symbols 626 and 638 include a display of a beer mug that represents a bar serving alcohol. The reel symbol 628 includes a display of a movie ticket that represents a movie theatre. The reel symbol 630 includes a display of a passport that represents that the wagering game player checked-in at a number of physical locations. For example, the passport can represent that the wagering game player has checked in at five different landmarks in Europe. The reel symbol 632 includes a display of an airplane that represents an airline terminal. The reel symbol 640 includes a display of a graphic for a ticket for admission to a circus that represents a circus. Of particularly note, the reel symbol 640 occupies two different reel locations for the reel 608. The wagering game player can unlock such a symbol based on multiple visits to this same physical location (as described above). The reel symbol 642 includes a display of a graphic for the Chicago Transit Authority (CTA). This reel symbol can represent that the wagering game player has checked at least N (e.g., 20) different times at different CTA locations. The reel symbol 644 includes a display of a grocery cart that presents a grocery store. The reel symbol 646 includes a display of a graphic for a particular subway stop near Yankee stadium that represents that particular subway stop.

Figure 7:
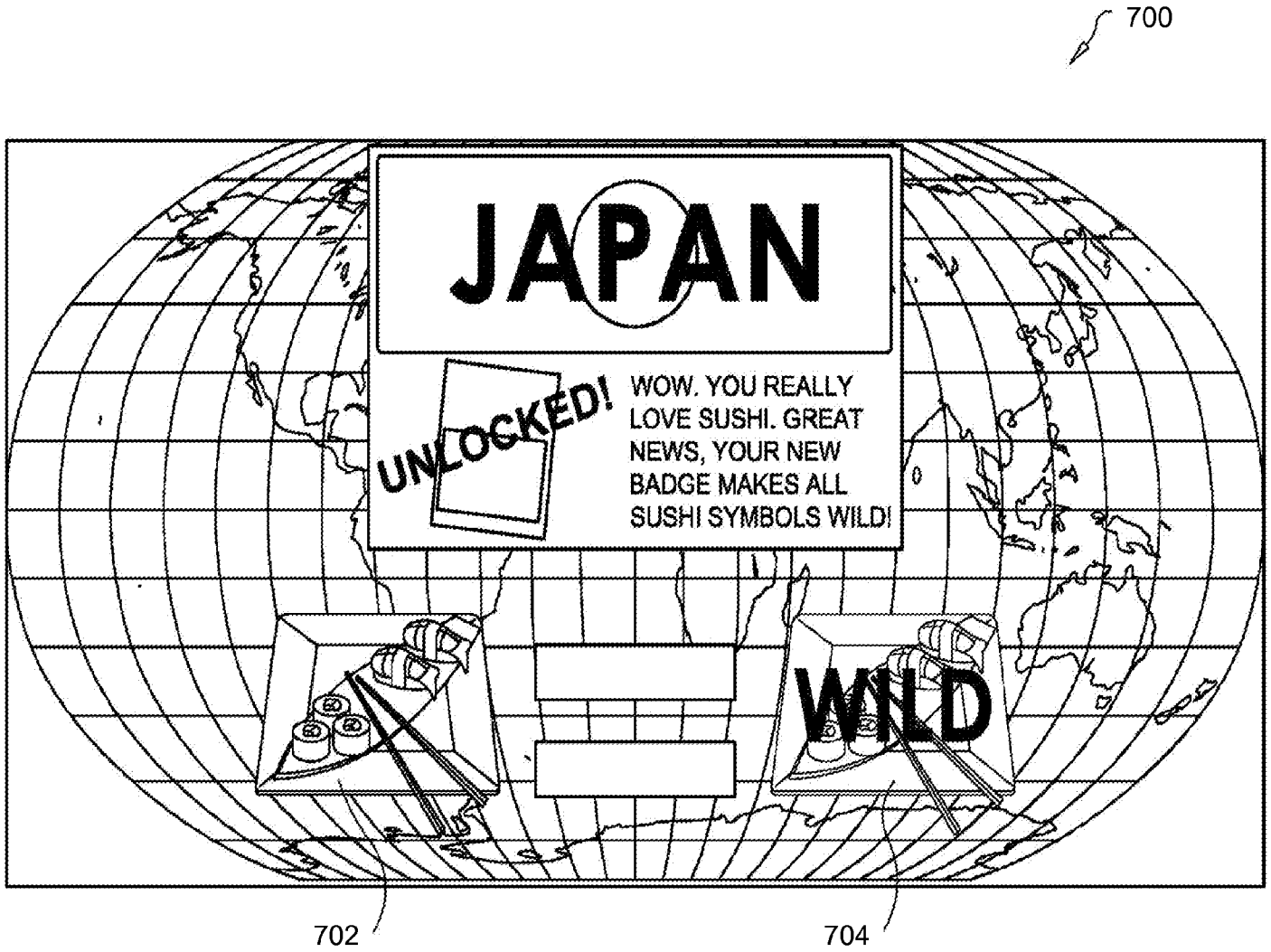
FIG. 7 depicts a screenshot of a screen of a wagering game for describing modified wagering game content, according to some embodiments.

FIG. 7 depicts a screenshot of a screen of a wagering game for describing modified wagering game content, according to some embodiments. A screenshot 700 is displayed at the wagering game to notify the wagering game player that a reel symbol has been converted from a non-wild reel symbol (reel symbol 702) to a wild reel symbol (reel symbol 704). As shown, the reel symbols 702-704 represent a sushi restaurant. In this example, the wagering game player can obtain the reel symbol 702 after a check-in at the sushi restaurant. After the wagering game player has checked-in at sushi restaurant more than X (e.g., 10) number of times, the reel symbol 702 is changed to the reel symbol 704 (non-wild to wild). This screenshot 700 can be shown at the wagering game after the wagering game player has logged in.

Example Operations

This section describes operations associated with some embodiments. In the discussion below, the flowcharts will be described with reference to the block diagrams presented above. However, in some embodiments, the operations can be performed by logic not described in the block diagrams.

In certain embodiments, the operations can be performed by executing instructions residing on machine-readable storage device, while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flowchart.

Figure 8:
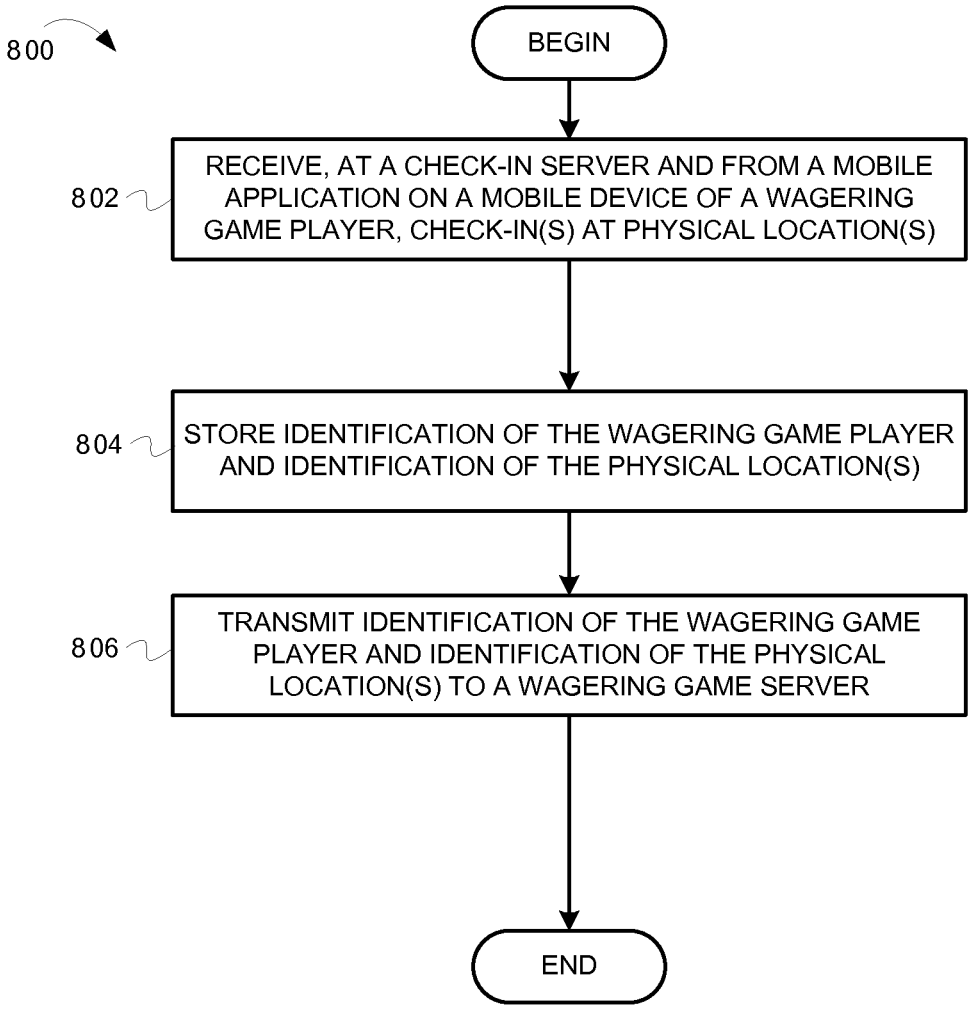
FIG. 8 depicts a flowchart of operations for tracking physical locations where the wagering game player has checked in, according to some embodiments.

FIG. 8 depicts a flowchart of operations for tracking physical locations where the wagering game player has checked in, according to some embodiments. The operations of a flowchart 800 are described in reference to FIG. 1. In this example, the operations of the flowchart 800 are performed by the check-in server 102. The operations of the flowchart 800 begin at block 802.

At block 802, a check-in server receives, from a mobile application on a mobile device of a wagering game player, check-in(s) at physical location(s). With reference to FIG. 1, the check-in server 102 receives the check-in transmissions 120-122 from the mobile device 108 of the wagering game player 106, in response to the wagering game player 106 checking-in at the physical locations 110-112. Operations of the flowchart 800 continue at block 804.

At block 804, the check-in server stores the identification of the wagering game player and identification of the physical location(s). With reference to FIG. 1, the check-in server 102 can store this data in machine-readable storage media therein. Operations of the flowchart 800 continue at block 806.

At block 806, the check-in server transmits the identification of the wagering game player and identification of the physical location(s) to a wagering game server. With reference to FIG. 1, the check-in server 102 can transmit this data to the wagering game server 118. In some embodiments, the check-in server 102 can provide this data periodically and/or upon demand by the wagering game server 118. For example, the wagering game server 118 can request this data for a particular wagering game player after the player has logged into a wagering game machine at the wagering game establishment 104. Operations of the flowchart 800 are complete.

Figure 9:
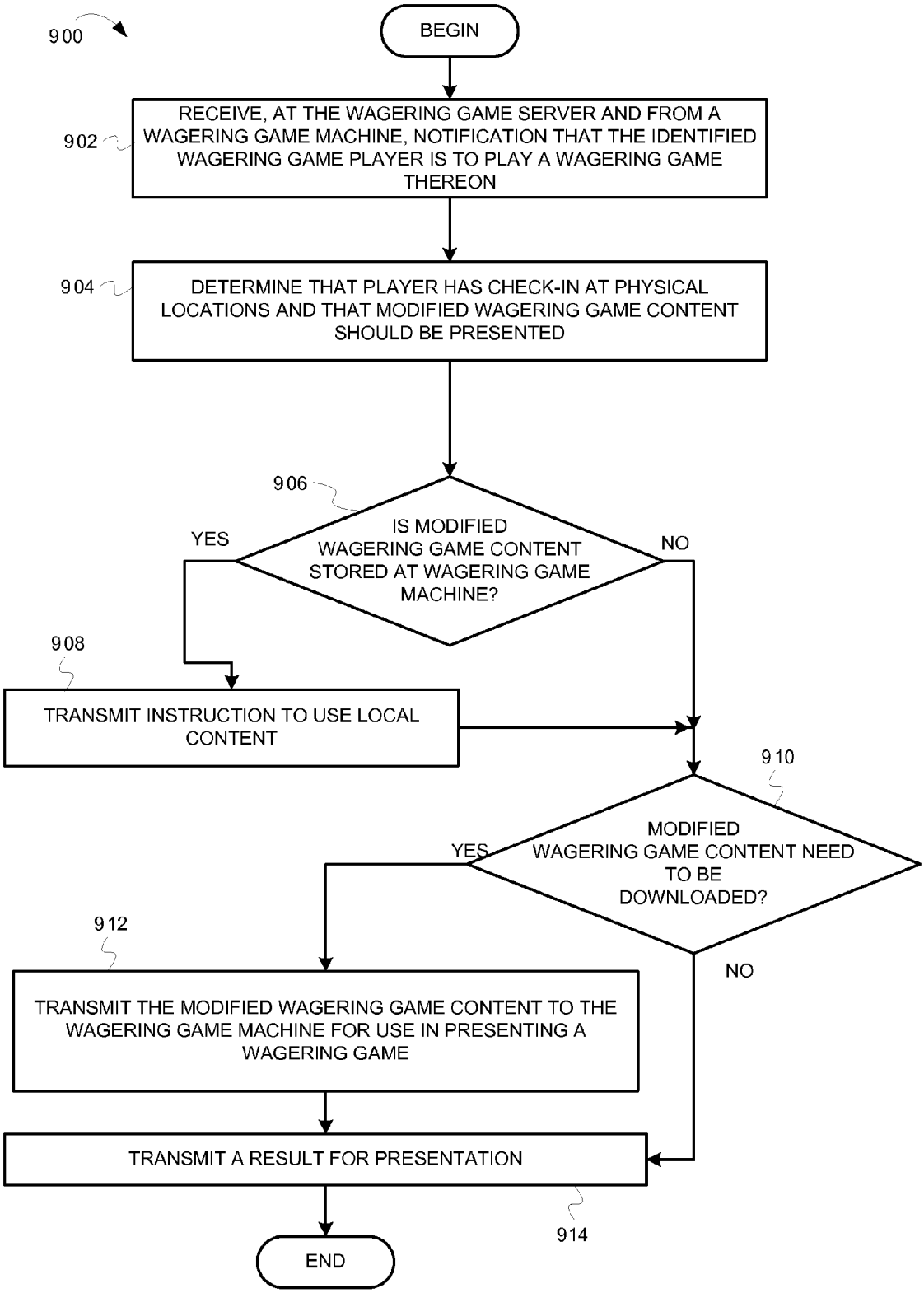
FIG. 9 depicts a flowchart of operations for including modified wagering game content for wagering games based on physical locations where the wagering game player has checked-in, according to some embodiments.

FIG. 9 depicts a flowchart of operations for including modified wagering game content for wagering games based on physical locations where the wagering game player has checked-in, according to some embodiments. The operations of a flowchart 900 are described in reference to FIG. 1. In this example, the operations of the flowchart 900 are performed by the wagering game server 118. The operations of the flowchart 900 begin at block 902.

At block 902, the wagering game server receives, from a wagering game machine, notification that the identified wagering game player is to play a wagering game thereon. With reference to FIG. 1, the wagering game player 106 provides some type of identification of themselves. For example, the wagering game player 106 can provide their identification by logging into their player account at the wagering game machine 114. In response, the wagering game machine 114 can transmit notification of the identification of the wagering game player 106 to the wagering game server 118. Operations of the flowchart 900 continue at block 904.

At block 904, the wagering game server determines that the wagering game player has checked-in at one or more physical locations and that modified wagering game content should be presented at the wagering game machine based on the check-ins. For example, check-ins at only some physical locations can modify wagering game content. Accordingly, the wagering game server 118 determines whether the recorded check-ins for the wagering game player allow for modification of the wagering game content. Also, there can be an option of whether to replace the original wagering game content with modified wagering game content. For example, the wagering game player can be given the option to replace the original wagering game content with modified wagering game content. Operations of the flowchart 900 continue at block 906.

At block 906, a determination is made of whether the modified wagering game content is stored at the wagering game machine. For example, some or all of the modified wagering game content (e.g., replacement images for reel symbols, replacement bonus games, etc.) for the identified physical locations can be stored in machine-readable storage media in the wagering game machine 114. The wagering game server 118 can make this determination. If there is any modified wagering game content (for the identified physical location(s) stored at the wagering game machine, operations of the flowchart 900 continue at block 908. Otherwise, operations of the flowchart 900 continue at block 910.

At block 908, the wagering game server transmits an instruction to the wagering game machine to use the modified wagering game content that is stored locally in a media in the wagering game machine. With reference to FIG. 1, the wagering game server 118 transmits this instruction to the wagering game machine 114. Operations of the flowchart 900 continue at block 910.

At block 910, a determination is made (for the identified physical location(s)) of whether any modified wagering game content needs to be downloaded. The wagering game server 118 can make this determination. In particular in some embodiments, modified wagering game content is transmitted from the wagering game server 118 if the modified wagering game content is not stored in machine-readable storage media in the wagering game machine 114. If any modified wagering game content needs to be transmitted from the wagering game server, operations of the flowchart 900 continue at block 912. Otherwise, operations of the flowchart 900 continue at block 914.

At block 912, the wagering game server transmits to the wagering game machine the modified wagering game content that needed to be provided. With reference to FIG. 1, the wagering game server 118 transmits the modified wagering game content to the wagering game machine 114—see the transmission 126. Accordingly as described, some or all of the modified wagering game content is transmitted from the wagering game server 118 (depending on what is stored in machine-readable storage media in the wagering game machine 114). Operations of the flowchart 900 continue at block 914.

At block 914, the wagering game server transmits a result for presentation of the wagering game. For example, the wagering game server can provide the random result for a slots game. Also, the wagering game machine can present the wagering game based on the modified wagering game content. Operations of the flowchart 900 are complete.

Wagering Game Machine Architecture and Network Environment

This section describes an example wagering game architecture and network environment of some embodiments.

Wagering Game Machine Architecture

Figure 10:
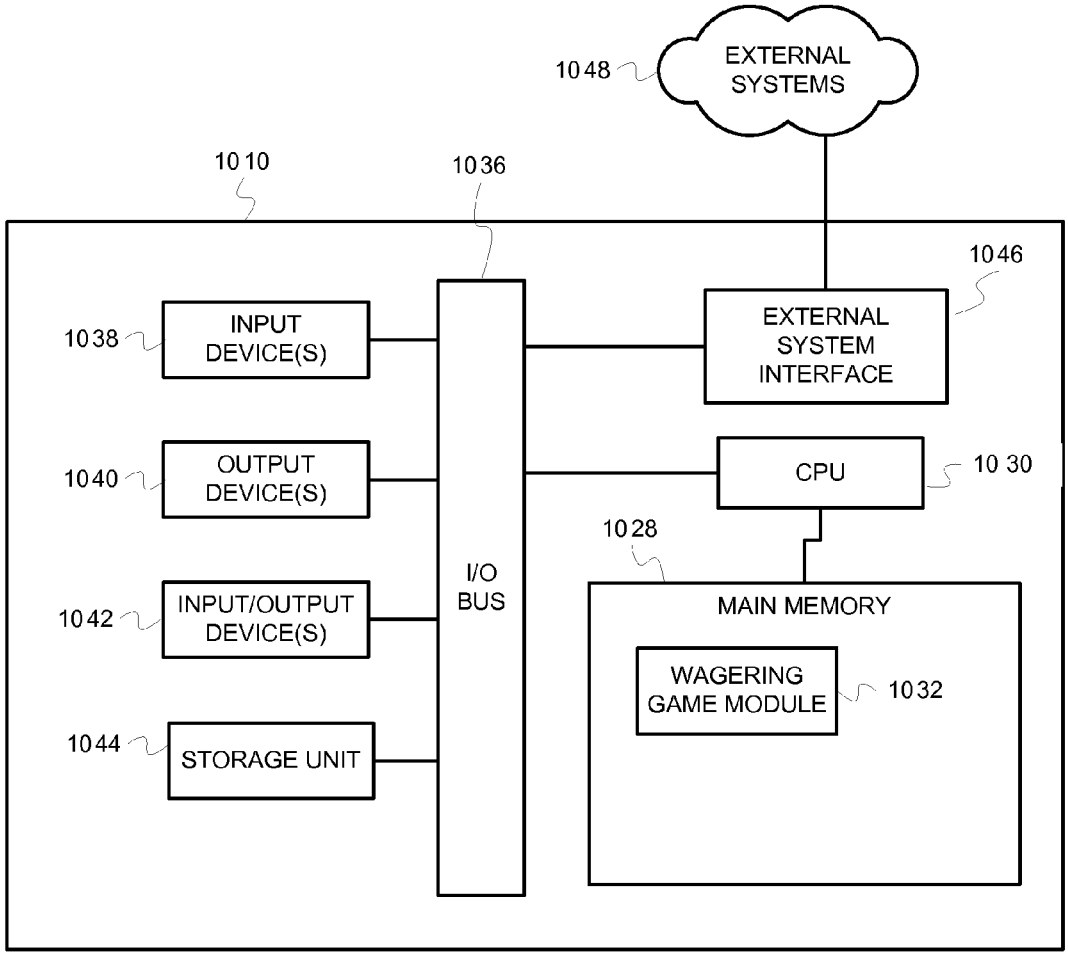
FIG. 10 depicts a block diagram illustrating a wagering game machine architecture, according to some embodiments.

FIG. 10 depicts a block diagram illustrating a wagering game machine architecture, according to some embodiments. The gaming terminal 1010 includes a central processing unit (CPU) 1030 connected to a main memory 1032. The CPU 1030 may include any suitable processor(s), such as those made by Intel and AMD. By way of example, the CPU 1030 includes a plurality of microprocessors including a master processor, a slave processor, and a secondary or parallel processor. CPU 1030, as used herein, comprises any combination of hardware, software, or firmware disposed in or outside of the gaming terminal 1010 that is configured to communicate with or control the transfer of data between the gaming terminal 1010 and a bus, another computer, processor, device, service, or network. The CPU 1030 comprises one or more controllers or processors and such one or more controllers or processors need not be disposed proximal to one another and may be located in different devices or in different locations. The CPU 1030 is operable to execute all of the various gaming methods and other processes disclosed herein. The main memory 1028 includes a wagering game module 1032. In one embodiment, the wagering game module 1032 may present wagering games, such as video poker, video black jack, video slots, video lottery, etc., in whole or part. In some embodiments, the wagering game module performs operations for presenting wagering games based on modified wagering game content (as described above).

The CPU 1030 is also connected to an input/output (I/O) bus 1036, which can include any suitable bus technologies, such as an AGTL+ frontside bus and a PCI backside bus. The I/O bus 1036 is connected to various input devices 1038, output devices 1040, and input/output devices 1042. The I/O bus 1036 is also connected to storage unit 1044 and external system interface 1046, which is connected to external system(s) 1048 (e.g., wagering game networks).

The external system 1048 includes, in various aspects, a gaming network, other gaming terminals, a gaming server, a remote controller, communications hardware, or a variety of other interfaced systems or components, in any combination. In yet other aspects, the external system 1048 may comprise a player's portable electronic device (e.g., cellular phone, electronic wallet, etc.) and the external system interface 1046 is configured to facilitate wireless communication and data transfer between the portable electronic device and the CPU 1030, such as by a near-field communication path operating via magnetic-field induction or a frequency-hopping spread spectrum RF signals (e.g., Bluetooth, etc.).

The gaming terminal 1010 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 1048 ("thin client" gaming terminal), or are distributed therebetween in any suitable manner ("intermediate client" gaming terminal).

Any component of the gaming terminal architecture may include hardware, firmware, or tangible machine-readable storage devices including instructions for performing the operations described herein. Machine-readable storage devices include any mechanism that stores information and provides the information in a form readable by a machine (e.g., gaming terminal, computer, etc.). For example, machine-readable storage devices include semiconductor read only memory (ROM), semiconductor random access memory (RAM), magnetic disk storage media, optical storage media, flash memory, etc.

Wagering Game Network

Figure 11:
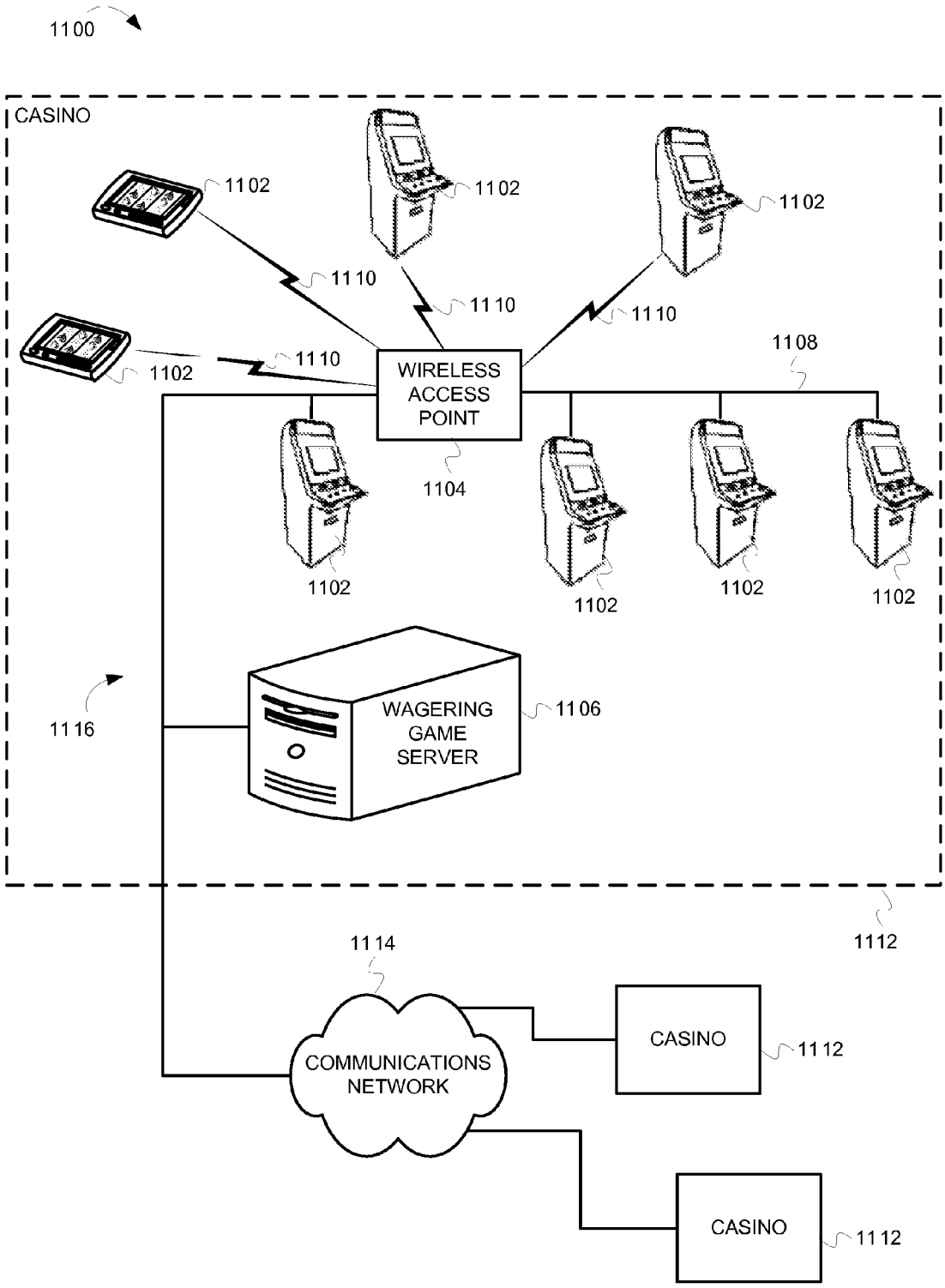
FIG. 11 depicts a block diagram illustrating a wagering game network, according to some embodiments.

FIG. 11 depicts a block diagram illustrating a wagering game network, according to some embodiments. As shown in FIG. 11, the wagering game network 1100 includes a plurality of casinos 1112 connected to a communications network 1114.

Each casino 1112 includes a local area network 1116, which includes an access point 1104, a wagering game server 1106, and wagering game machines 1102. The access point 1104 provides wireless communication links 1110 and wired communication links 1108. The wired and wireless communication links can employ any suitable connection technology, such as Bluetooth, 802.11, Ethernet, public switched telephone networks, SONET, etc. In some embodiments, the wagering game server 1106 can serve wagering games and distribute content to devices located in other casinos 1112 or at other locations on the communications network 1114.

The wagering game machines 1102 described herein can take any suitable form, such as floor standing models, handheld mobile units, bartop models, workstation-type console models, etc. Further, the wagering game machines 1102 can be primarily dedicated for use in conducting wagering games, or can include non-dedicated devices, such as mobile phones, personal digital assistants, personal computers, etc. In one embodiment, the wagering game network 1100 can include other network devices, such as accounting servers, wide area progressive servers, player tracking servers, and/or other devices suitable for use in connection with embodiments of the invention.

In some embodiments, wagering game machines 1102 and wagering game servers 1106 work together such that a wagering game machine 1102 can be operated as a thin, thick, or intermediate client. For example, one or more elements of game play may be controlled by the wagering game machine 1102 (client) or the wagering game server 1106 (server). Game play elements can include executable game code, lookup tables, configuration files, game outcome, audio or visual representations of the game, game assets or the like. In a thin-client example, the wagering game server 1106 can perform functions such as determining game outcome or managing assets, while the wagering game machine 1102 can present a graphical representation of such outcome or asset modification to the user (e.g., player). In a thick-client example, the wagering game machines 1102 can determine game outcomes and communicate the outcomes to the wagering game server 1106 for recording or managing a player's account. In some embodiments, the wagering game machines 1102 can have handheld devices and can be part of communal event (as described above).

In some embodiments, either the wagering game machines 1102 (client) or the wagering game server 1106 can provide functionality that is not directly related to game play. For example, account transactions and account rules may be managed centrally (e.g., by the wagering game server 1106) or locally (e.g., by the wagering game machine 1102). Other functionality not directly related to game play may include power management, presentation of advertising, software or firmware updates, system quality or security checks, etc.

In some embodiments, the wagering game server 1106 can host online wagering games, such as by hosting one or more online wagering game websites. Players can sign-on to such websites and play wagering games via web browsers, client applications, etc. In some embodiments, online gaming functionality is performed by an online gaming server (not shown), where the online gaming server does not determine results for the wagering game machines 1102.

Any of the wagering game network components (e.g., the wagering game machines 1102) can include hardware and machine-readable media including instructions for performing the operations described herein.

Example Wagering Game Machine

Figure 12:
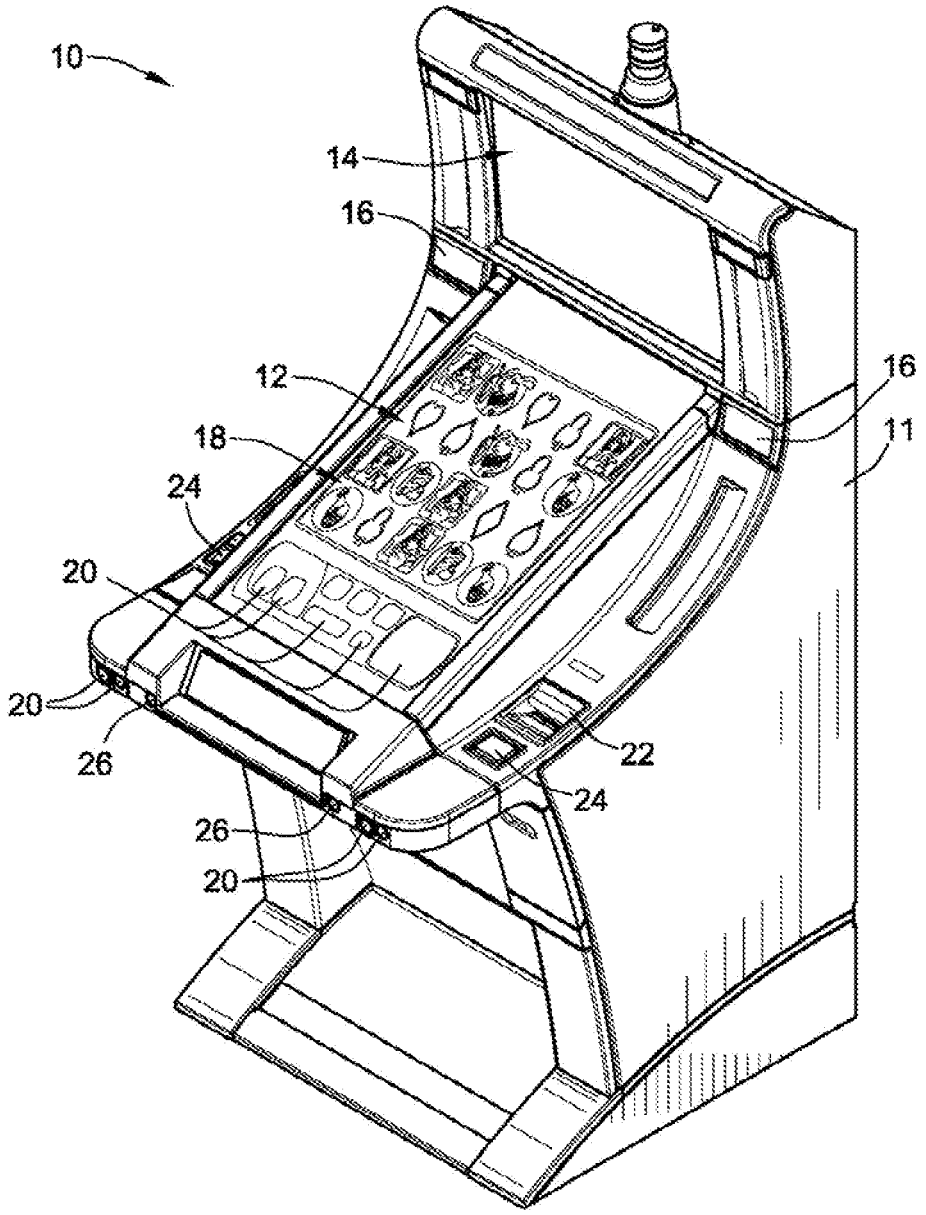
FIG. 12 depicts a perspective view of a wagering game machine, according to some embodiments.

FIG. 12 depicts a perspective view of a wagering game machine, according to some embodiments. Referring to FIG. 12, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0062196 and US2010/0234099, which are incorporated herein by reference in their entireties.

The gaming terminal 10 illustrated in FIG. 12 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 13:
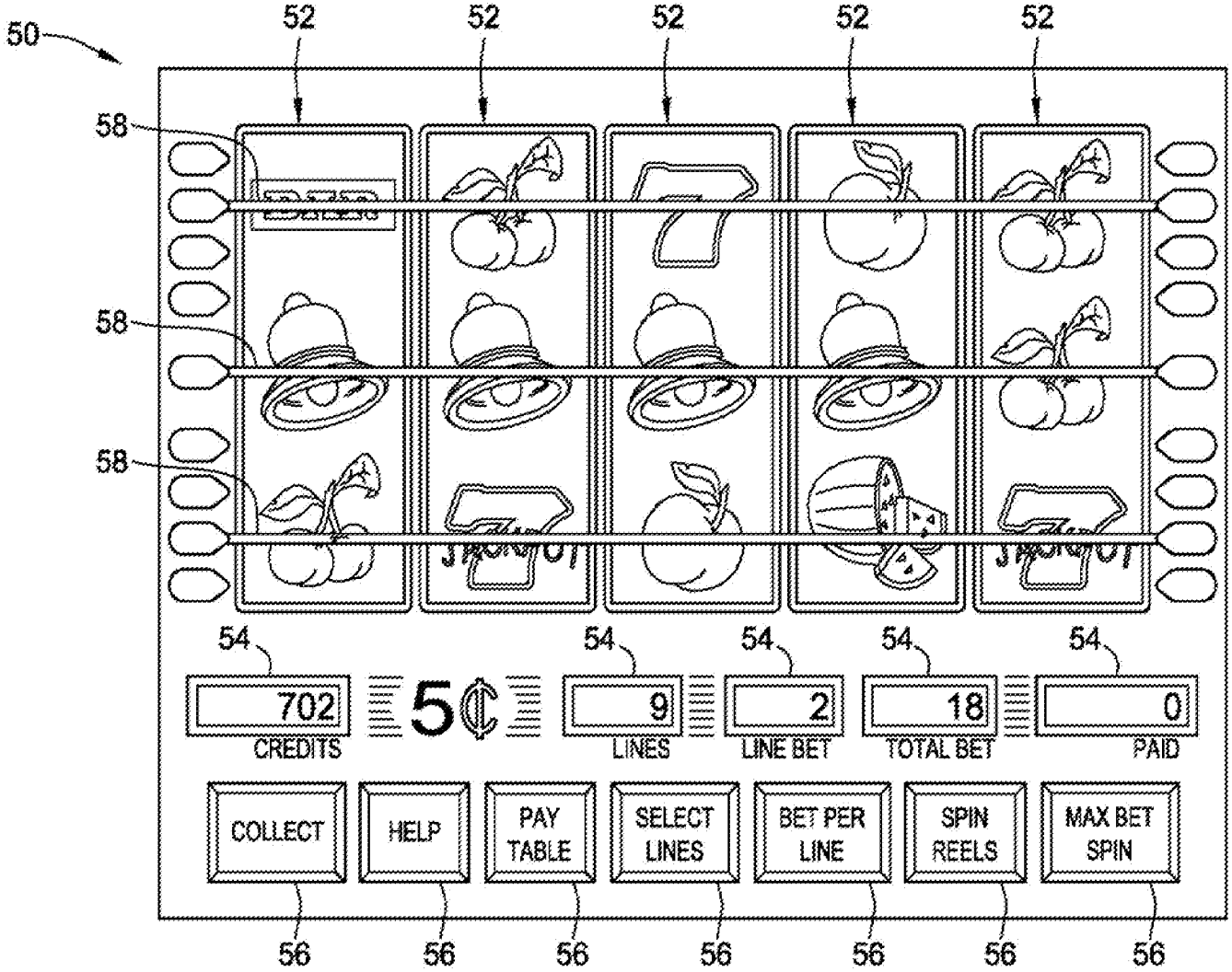
FIG. 13 depicts an image of a base-game screen for a wagering game machine, according to some embodiments.

FIG. 13 depicts an image of a base-game screen for a wagering game machine, according to some embodiments. Referring to FIG. 13, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 12. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 1030) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 1044), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method of operating a gaming system, said method comprising:

receiving a check-in request initiated by a mobile device, wherein the check-in request indicates, via a global positioning device, a physical location near the mobile device at a time of a check-in and an identification of a wagering game player associated with the mobile device, wherein the physical location is external to a wagering game establishment;

detecting, via at least one of one or more electronic input devices of a wagering game machine, a physical item associated with a monetary value that establishes a credit balance, wherein the wagering game machine includes the one or more electronic input devices, an electronic display device, and one or more controllers;

replacing, by one or more processors after the wagering game player is logged into a player account at the wagering game machine, original wagering game content with modified wagering game content in response to receiving the first check-in request, the modified wagering game content modifying an outcome of a wagering game, wherein the modified wagering game content is associated with an attribute of the physical location;

initiating the wagering game in response to an input indicative of a wager covered by the credit balance;

presenting, on the electronic display device of the wagering game machine, the wagering game with the modified wagering game content in place of the original wagering game content; and receiving, via at least one of the one or more electronic input devices, a cashout input that initiates a payout from the credit balance.

2. The method of claim 1, wherein the modified wagering game content indicates the physical location.

3. The method of claim 1, further comprising:

receiving, over a computer network, the modified wagering game content at the wagering game machine.

4. The method of claim 1, wherein the physical location is associated with a business entity, and wherein a portion of the modified wagering game content is sponsored by the business entity.

5. The method of claim 4, wherein the portion of the modified wagering game content comprises a game result that includes an award of monetary value provided by the business entity.

6. The method of claim 1, wherein the modified wagering game content varies based on a number of check-in requests initiated by the mobile device near the physical location.

7. The method of claim 1, wherein prior to the replacing, presenting, on the electronic display device of the wagering game machine, the wagering game with the original wagering game content.

8. A wagering game machine comprising:

one or more electronic input devices;

at least one electronic display device;

one or more controllers;

at least one processor; and at least one memory device configured to store instructions that, when executed by the at least one processor, cause the wagering game machine to:

receive a first check-in request initiated by a mobile device, wherein the first check-in request indicates, via a global positioning device, a first physical location near the mobile device at a first time of a first check-in and an identification of a wagering game player associated with the mobile device, wherein the physical location is external to a wagering game establishment, and wherein the wagering game machine is inside the wagering game establishment;

detect, via at least one of the one or more electronic input devices, a physical item associated with a monetary value that establishes a credit balance;

replace, after the wagering game player is logged into a player account at the wagering game machine, original wagering game content with modified wagering game content in response to the check-in request being received, the modified wagering game content modifying an outcome of a wagering game, wherein the modified wagering game content is associated with an attribute of the physical location;

initiate the wagering game in response to an input indicative of a wager covered by the credit balance;

present, on the at least one electronic display device, the wagering game with the modified wagering game content in place of the original wagering game content; and receive, via at least one of the one or more electronic input devices, a cashout input that initiates a payout from the credit balance.

9. The wagering game machine of claim 8, wherein the modified wagering game content indicates the physical location.

10. The wagering game machine of claim 8, wherein the instructions further cause the wagering game machine to receive, over a computer network, the modified wagering game content.

11. The wagering game machine of claim 8, wherein the physical location is associated with a business entity, and wherein a portion of the modified wagering game content is sponsored by the business entity.

12. The wagering game machine of claim 11, wherein the portion of the modified wagering game content comprises a game result that includes an award of monetary value provided by the business entity, wherein modifying the outcome of the wagering game comprises modifying a value of a symbol from a pay table for the wagering game in response to receiving the check-in request, and wherein the modifying the value of the symbol comprises selecting a symbol from the pay table whose modification would cause the game result to provide at least the award of monetary value provided by the business entity.

13. The wagering game machine of claim 8, wherein the modified wagering game content varies based on a number of check-in requests initiated by the mobile device near the physical location.

14. The wagering game machine of claim 8, wherein the instructions further cause the wagering game machine to present, on the at least one electronic display device, the wagering game with the original wagering game content prior to replacing the original wagering game content.

15. One or more non-transitory machine-readable storage media including instructions which, when executed by one or more processors of a wagering game machine, cause the one or more processors to perform operations comprising:

receiving a check-in request initiated by a mobile device, wherein the check-in request indicates, via global positioning device, a physical location near the mobile device at a time of check-in and an identification of a wagering game player associated with the mobile device, wherein the physical location is external to a wagering game establishment, wherein the wagering game machine is inside the wagering game establishment, and wherein the wagering game machine includes one or more electronic input devices, at least one electronic display device, and one or more controllers;

detecting, via at least one of the one or more electronic input devices, a physical item associated with a monetary value that establishes a credit balance;

replacing after the wagering game player is logged into a player account at the wagering game machine, original wagering game content with modified wagering game content in response to receiving the check-in request, the modified wagering game content modifying an outcome of a wagering game, wherein the modified wagering game content is associated with an attribute of the physical location;

initiating the wagering game in response to an input indicative of a wager covered by the credit balance;

presenting on the at least one electronic display device, the wagering game with the modified wagering game content in place of the original wagering game content; and receiving, via at least one of the one or more electronic input devices, a cashout input that initiates a payout from the credit balance.

16. The one or more non-transitory machine-readable storage media of claim 15, wherein the operations for presenting the wagering game include operations for outputting a result of the wagering game, wherein the result includes an award of monetary value provided by a business entity.

17. The one or more non-transitory machine-readable storage media of claim 15, wherein the wagering game comprises a slots game having reel symbols, and wherein the operations for replacing the original wagering game content includes operations comprising replacing at least one of the reel symbols with a modified reel symbol.

18. The one or more non-transitory machine-readable storage media of claim 17, wherein the operations for replacing the at least one of the reel symbols with the modified reel symbol includes operations comprising:

replacing a first one of the at least one of the reel symbols associated with a first payout value in response to a first number of check-ins by the wagering game player at the physical location; and replacing a second one of the at least one of the reel symbols associated with a second payout value that is higher than the first payout value in response to a second number of check-ins by the wagering game player at the physical location, the second number of check-ins being greater than the first number of check-ins.

19. The one or more non-transitory machine-readable storage media of claim 15, wherein prior to the operations for replacing, the one or more processors are configured to perform operations for presenting, on the at least one electronic display device of the wagering game machine, the wagering game with the original wagering game content.

20. The method of claim 1, further comprising:

receiving a second check-in request at a second physical location by the wagering game player using the mobile device, wherein the second check-in comprises the identification of the wagering game player and the second physical location near where the mobile device is located at a second time of a second check-in, wherein the second physical location is external to the wagering game establishment;

replacing, after receiving the check-in request and the second check-in request and after the wagering game player is logged into the player account at the wagering game machine, the original wagering game content with a second modified wagering game content based on the check-in and the second check-in, wherein the second modified wagering game content is different from the modified wagering game content; and presenting, on the at least one electronic display device of the wagering game machine, the wagering game with the second modified wagering game content in place of the original wagering game content.

21. The wagering game machine of claim 8, wherein the instructions further cause the wagering game machine to:

replace, after the check-in request and a second check-in request are received and after the wagering game player is logged into the player account at the wagering game machine, the original wagering game content with a second modified wagering game content, wherein the second check-in request is initiated by the wagering game player at a second physical location, wherein the second modified wagering game content is different from the modified wagering game content; and present, on the at least one electronic display device, the wagering game with the second modified wagering game content in place of the original wagering game content.

22. The one or more non-transitory machine-readable storage media of claim 15, the instructions further causing the one or more processors to perform operations comprising:

receiving a second check-in request at a second physical location by the wagering game player using the mobile device, wherein the second check-in request comprises the identification of the wagering game player and the second physical location near where the mobile device is located at a second time of a second check-in, wherein the second physical location is external to the wagering game establishment;

replacing, after receiving the first check-in request and the second check-in request and after the wagering game player is logged into the player account at the wagering game machine, the original wagering game content with a second modified wagering game content based on the check-in and the second check-in, wherein the second modified wagering game content is different from the modified wagering game content; and presenting, on the at least one electronic display device of the wagering game machine, the wagering game with the second modified wagering game content in place of the original wagering game content.

23. The method of claim 1 wherein the modifying the outcome of the wagering game comprises modifying a value of a symbol from a pay table for the wagering game in response to receiving the check-in request.

24. The method of claim 23, wherein the replacing the original wagering game content with the modified wagering game content is in response to determining that the check-in request has been received a threshold number of times from one or more geographic locations associated with a business entity.

* * * * *